US009953757B2

(12) United States Patent
Eshima et al.

(10) Patent No.: US 9,953,757 B2
(45) Date of Patent: Apr. 24, 2018

(54) LAMINATED COIL COMPONENT AND MANUFACTURING METHOD FOR THE SAME

(71) Applicant: Murata Manufacturing Co., Ltd., Nagaokakyo-shi, Kyoto-fu (JP)

(72) Inventors: Kazuki Eshima, Nagaokakyo (JP); Tomoya Yokoyama, Nagaokakyo (JP); Takayuki Okada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 7 days.

(21) Appl. No.: 15/344,793

(22) Filed: Nov. 7, 2016

(65) Prior Publication Data

US 2017/0053727 A1 Feb. 23, 2017

Related U.S. Application Data

(63) Continuation of application No. PCT/JP2015/056743, filed on Mar. 6, 2015.

(30) Foreign Application Priority Data

May 15, 2014 (JP) ..... 2014-101735

(51) Int. Cl.
*H01F 5/00* (2006.01)
*H01F 27/30* (2006.01)
(Continued)

(52) U.S. Cl.
CPC ..... *H01F 27/24* (2013.01); *H01F 5/00* (2013.01); *H01F 17/0013* (2013.01);
(Continued)

(58) Field of Classification Search
CPC ..... H01F 5/00; H01F 27/00–27/36
(Continued)

(56) References Cited

U.S. PATENT DOCUMENTS 5,610,443 A 3/1997 Inagaki et al.
6,621,400 B2 * 9/2003 Horie ..... H01F 17/0013 336/200
(Continued)

FOREIGN PATENT DOCUMENTS

JP 2012-129367 A 7/2012
JP 2012-164770 A 8/2012
(Continued)

OTHER PUBLICATIONS

Official Communication issued in corresponding International Application PCT/JP2015/056743, dated May 19, 2015.

*Primary Examiner* — Tuyen Nguyen
(74) *Attorney, Agent, or Firm* — Keating & Bennett, LLP

(57) ABSTRACT

In a laminated coil component include coil conductors are respectively included on magnetic layers and a carbon paste is included on a magnetic layer. The coil conductors include a partial coil conductor and a partial coil conductor respectively corresponding to an outer side portion circle and an inner side portion circle defining two circles. A width of the carbon paste at least partially overlaps an interval between the outer side portion circle and the inner side portion circle defining the two circles, and extends circularly along the two circles. The carbon paste is shifted to the interval between the outer side portion circle and the inner side portion circle defining the two circles at the time of pressure-bonding the magnetic layers. The carbon paste vanishes when being calcined to define an air gap.

20 Claims, 17 Drawing Sheets

(51) Int. Cl.

| | |
|---|---|
| ***H01F 27/24*** | (2006.01) |
| ***H01F 27/28*** | (2006.01) |
| ***H01F 41/02*** | (2006.01) |
| ***H01F 41/04*** | (2006.01) |
| ***H01F 17/00*** | (2006.01) |
| *H01F 27/29* | (2006.01) |

(52) U.S. Cl.
CPC ..... *H01F 27/2804* (2013.01); *H01F 27/30* (2013.01); *H01F 41/0206* (2013.01); *H01F 41/041* (2013.01); *H01F 41/046* (2013.01); *H01F 27/292* (2013.01); *H01F 2017/0066* (2013.01); *H01F 2027/2809* (2013.01)

(58) Field of Classification Search
USPC ..... 336/65, 83, 200, 232–234
See application file for complete search history.

(56) References Cited

U.S. PATENT DOCUMENTS

| | | | | |
|---|---|---|---|---|
| 7,034,637 | B2 * | 4/2006 | Kono | C03C 3/085 333/181 |
| 7,511,594 | B2 * | 3/2009 | Sasaki | H03H 1/0007 333/132 |
| 7,663,225 | B2 * | 2/2010 | Kudo | H01F 17/0013 156/89.12 |
| 2009/0256668 | A1 * | 10/2009 | Noma | H01F 17/0013 336/200 |
| 2012/0326827 | A1 | 12/2012 | Nanjyo et al. | |
| 2017/0025220 | A1 * | 1/2017 | Nakaniwa | H01F 27/245 |

FOREIGN PATENT DOCUMENTS

| | | | |
|---|---|---|---|
| JP | 5196038 | B2 | 5/2013 |
| WO | 96/28832 | A1 | 9/1996 |

* cited by examiner

FIG. 3A NONMAGNETIC LAYER L1
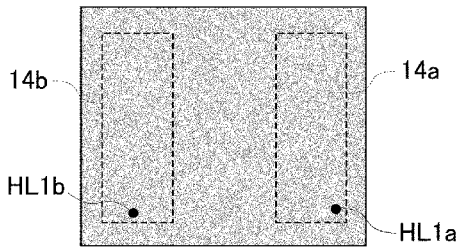
FIG. 3B MAGNETIC LAYER L2
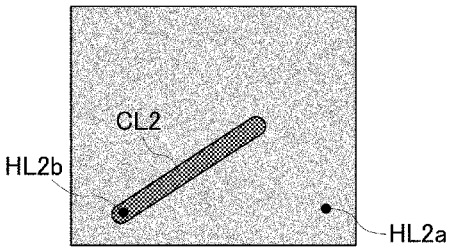
FIG. 3C MAGNETIC LAYER L3
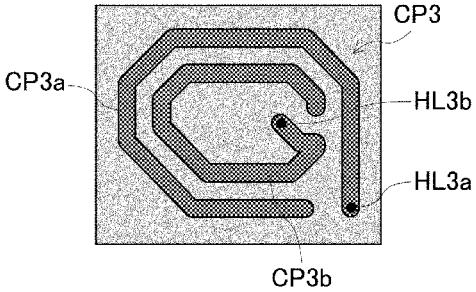
FIG. 3D MAGNETIC LAYER L4
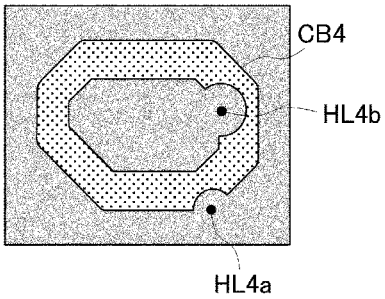
FIG. 3E MAGNETIC LAYER L5
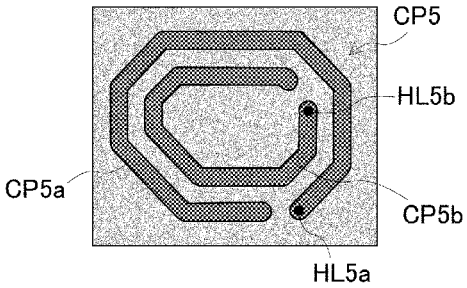
FIG. 3F MAGNETIC LAYER L6
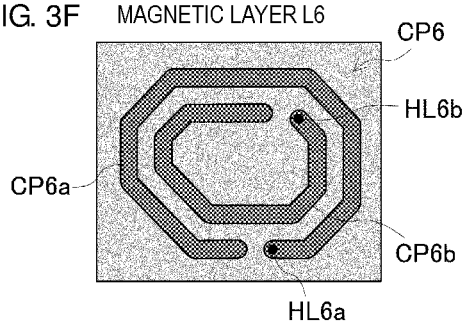
FIG. 3G MAGNETIC LAYER L7
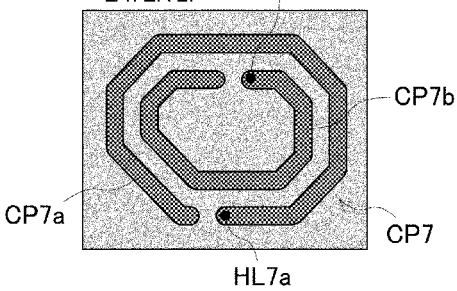
FIG. 3H MAGNETIC LAYER L8
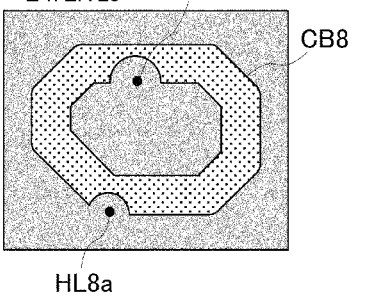

FIG. 5A MAGNETIC LAYER L3&L5
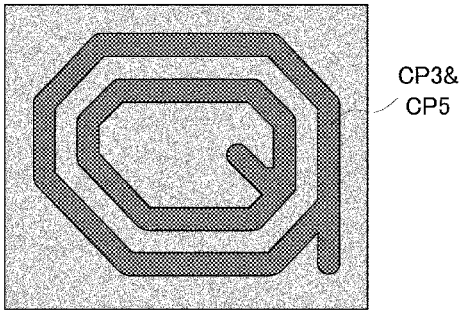
FIG. 5D MAGNETIC LAYER L7&L9
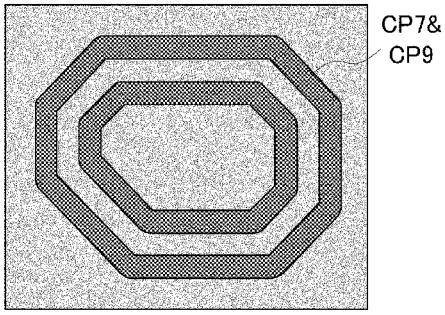
FIG. 5B MAGNETIC LAYER L4
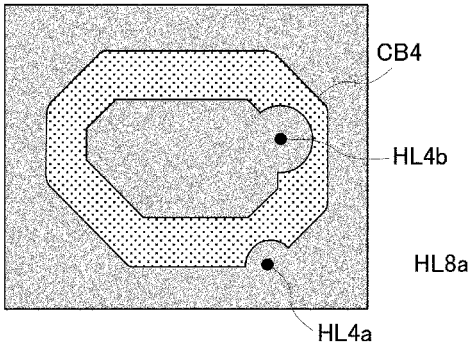
FIG. 5E MAGNETIC LAYER L8
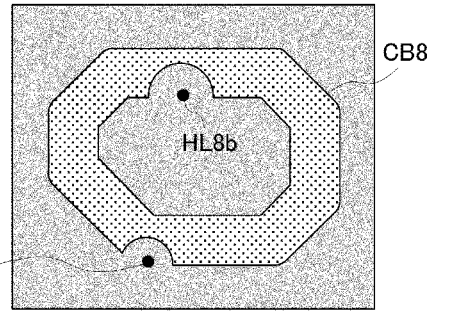
FIG. 5C MAGNETIC LAYER L3 to L5
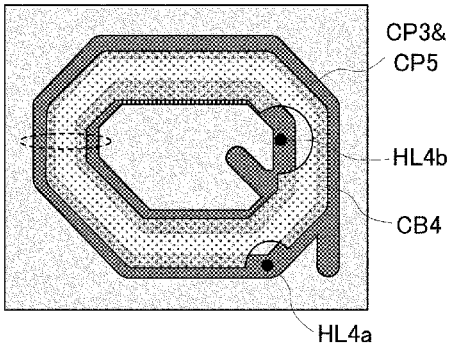
FIG. 5F MAGNETIC LAYER L7 to L9
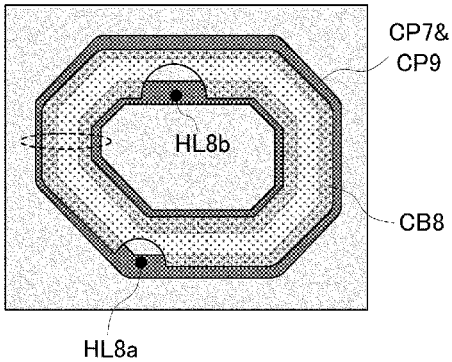

FIG. 6A STACKING TIME
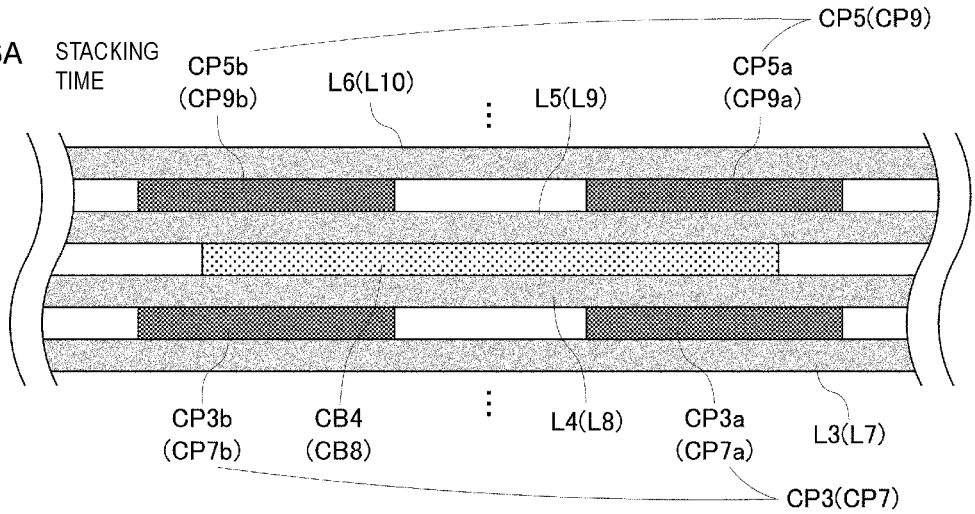
FIG. 6B PRESSURE-BONDING TIME
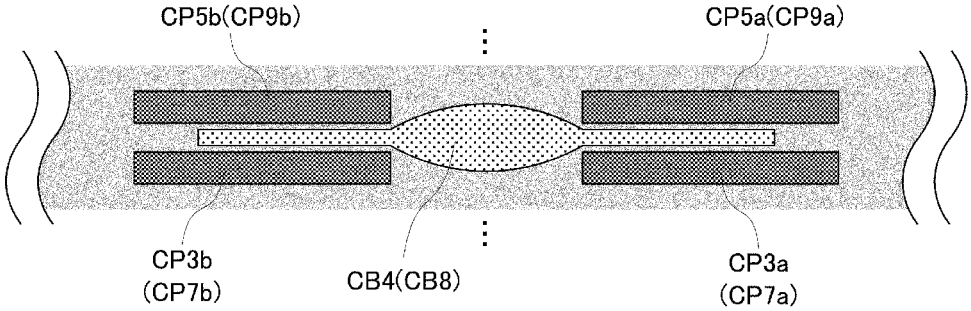
FIG. 6C AFTER CALCINATION
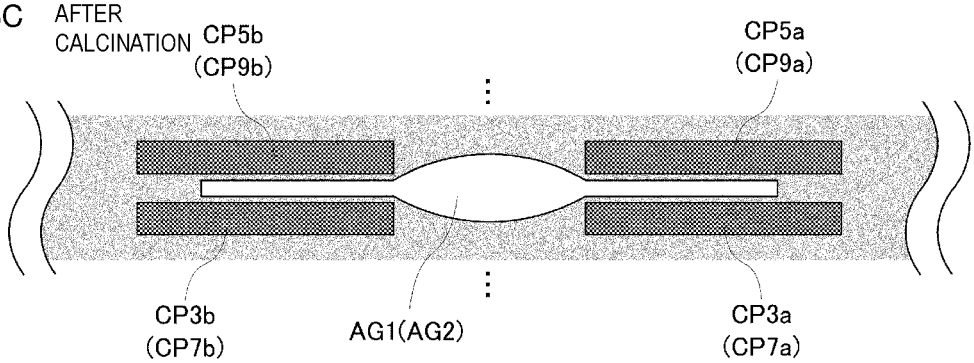

FIG. 9A STACKING TIME
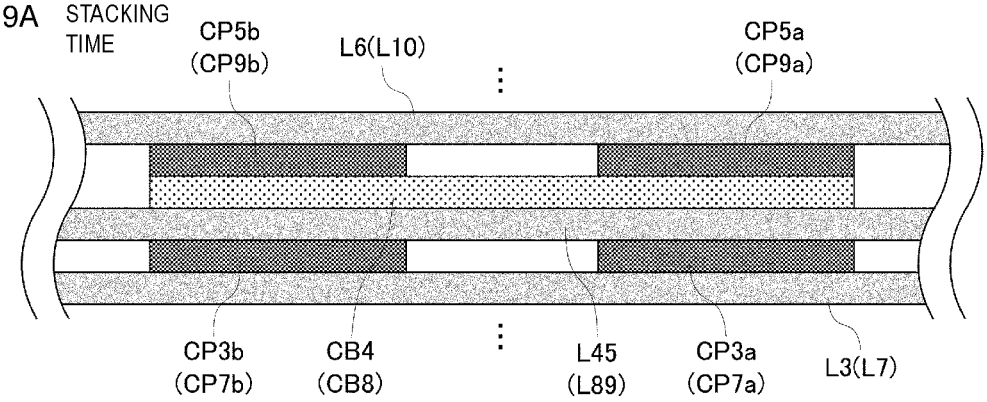
FIG. 9B PRESSURE-BONDING TIME
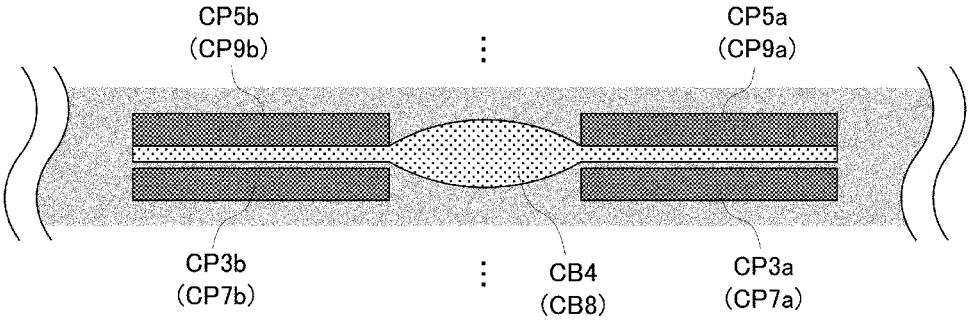
FIG. 9C AFTER CALCINATION
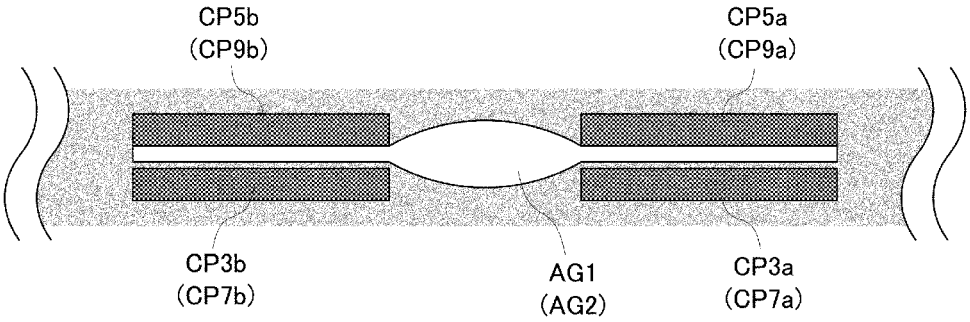

FIG. 10A NONMAGNETIC LAYER L1
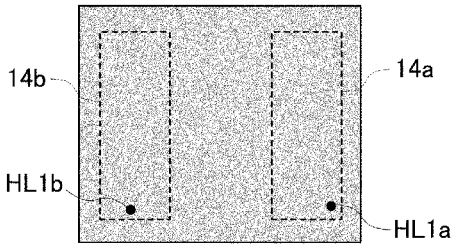
FIG. 10B MAGNETIC LAYER L2
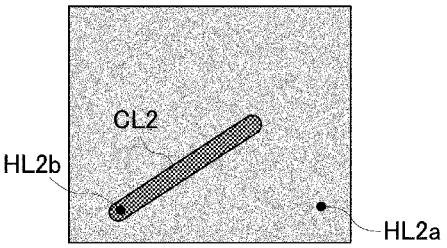
FIG. 10C MAGNETIC LAYER L3
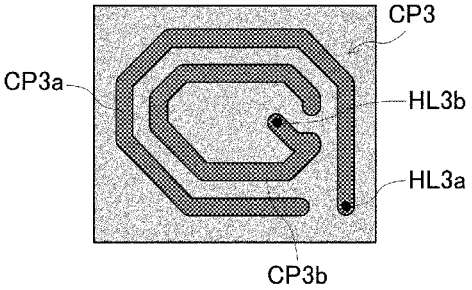
FIG. 10D MAGNETIC LAYER L5
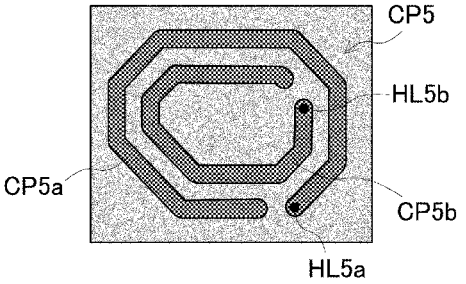
FIG. 10E MAGNETIC LAYER L6
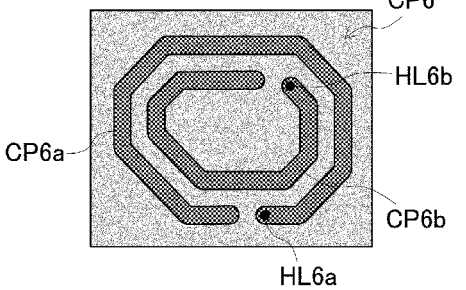
FIG. 10F MAGNETIC LAYER L7
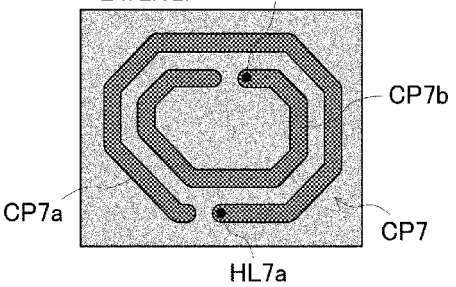

LAMINATED COIL COMPONENT AND MANUFACTURING METHOD FOR THE SAME

CROSS REFERENCE TO RELATED APPLICATIONS

This application claims the benefit of priority to Japanese Patent Application 2014-101735 filed on May 15, 2014 and is a Continuation Application of PCT/JP2015/056743 filed on Mar. 6, 2015. The entire contents of each application are hereby incorporated herein by reference.

BACKGROUND OF THE INVENTION

1. Field of the Invention

The present invention relates to laminated coil components and manufacturing methods for laminated coil components, and particularly relates to a laminated coil component that is defined by stacking and pressure-bonding a plurality of magnetic layers where a plurality of coil conductors defining a coil are respectively included, and then calcining the pressure-bonded magnetic layers, and a manufacturing method for the laminated coil component.

2. Description of the Related Art

Examples of laminated coil components are disclosed in Japanese Patent No. 5196038 and Japanese Unexamined Patent Application Publication No. 2012-129367. According to Japanese Patent No. 5196038 and Japanese Unexamined Patent Application Publication No. 2012-129367, a coil-embedded board is made by laminating magnetic layers and nonmagnetic layers (or feebly magnetic layers). The coil is defined by applying an electrode paste on each of the magnetic layers and nonmagnetic layers in a coil shape. A material that defines an air gap is applied to a coil section so as to alleviate stress strain caused by a difference in thermal expansion coefficients between the magnetic body and the electrode material. The material that defines the air gap is provided within a contour of a circle defined by the coil in plan view of the board. The material that defines the air gap, as applied in the above-described manner, vanishes when the coil-embedding board is calcined, thus defining an air gap inside the board.

In Japanese Patent No. 5196038 and Japanese Unexamined Patent Application Publication No. 2012-129367, the coil is wound a single turn in each layer, and none of the above documents describe a structure in which the coil is wound in multiple turns in each layer so as to increase an inductance value of the coil.

If the coil includes the structure of multiple turns as described above in order to increase the inductance value, it is difficult to apply the material that defines the air gap so that it at least partially overlaps with the electrode material. In addition, since unevenness appears in each layer along a diameter direction of the coil, a sufficient pressure is not exerted in a vertical direction when the layers are stacked and pressure-bonded. This raises a risk that unintended separation occurs after the calcination.

If a micro DC-DC converter is used in a light load region, an inductance value significantly influences the conversion efficiency. A spiral structure for increasing the inductance value is considered to play an important role particularly in a laminated coil component for a micro DC-DC converter.

SUMMARY OF THE INVENTION

Preferred embodiments of the present invention provide a laminated coil component and a manufacturing method for the laminated coil component that alleviates stress strain caused by a difference in thermal expansion coefficients and that significantly reduces or prevents unintended separation of magnetic layers.

According to a preferred embodiment of the present invention, a laminated coil is component defined by stacking and pressure-bonding a plurality of magnetic layers in a first direction where a plurality of coil conductors defined by a coil which is wound in multiple turns in each of the first direction and a second direction perpendicular or substantially perpendicular to the first direction and whose winding axis extends in the first direction are respectively included, and then calcining the pressure-bonded magnetic layers, wherein the plurality of coil conductors include two specific coil conductors that are adjacent to or in the vicinity of each other in the first direction and that define multiple circles or substantially circular shapes when viewed in the first direction, the two specific coil conductors each include a plurality of partial coil conductors respectively corresponding to a plurality of circles or substantially circular shapes defining the multiple circles or substantially circular shapes, and a circular air gap is defined, at a position sandwiched between the two specific coil conductors when viewed in the second direction, including a width that at least partially overlaps an interval between the plurality of circles or substantially circular shapes defining the multiple circles or substantially circular shapes when viewed in the first direction and extending along the multiple circles or substantially circular shapes.

Preferably, the air gap defined by a material that vanishes when calcined, for example.

Preferably, the plurality of partial coil conductors includes the same or substantially the same width when viewed in the first direction, for example.

Preferably, the plurality of coil conductors at least partially overlaps with each other when viewed in the first direction, for example.

Preferably, an integrated circuit is mounted on a top surface of a multilayer body, for example.

A preferred embodiment of the present invention provides a manufacturing method for a laminated coil component that is defined by stacking and pressure-bonding a plurality of magnetic layers in a first direction where a plurality of coil conductors defining a coil which is wound in multiple turns in each of the first direction and a second direction perpendicular or substantially perpendicular to the first direction and whose winding axis extends in the first direction are respectively included, and then calcining the pressure-bonded magnetic layers, wherein the plurality of coil conductors include two specific coil conductors that are adjacent to or in the vicinity of each other in the first direction and that define multiple circles or substantially circular shapes when viewed in the first direction, the two specific coil conductors each include a plurality of partial coil conductors respectively corresponding to a plurality of circles or substantially circular shapes defining the multiple circles or substantially circular shapes, and a circular air gap is defined, at a position sandwiched between the two specific coil conductors when viewed in the second direction, including a width that at least partially overlaps an interval between the plurality of circles or substantially circular shapes defining the multiple circles or substantially circular shapes when viewed in the first direction and extending along the multiple circles or substantially circular shapes. The method includes a first application process in which the two specific coil conductors are applied on two respective magnetic layers, a second application process in which a material for defining the air gap is applied on a magnetic layer different from the two magnetic layers on which the first application process is performed, and a preparation process in which a multilayer body before calcination is prepared by inserting the magnetic layer processed by the second application process between the two magnetic layers processed by the first application process.

A preferred embodiment of the present invention provides a manufacturing method for a laminated coil component that is defined by stacking and pressure-bonding a plurality of magnetic layers in a first direction where a plurality of coil conductors defining a coil which is wound in multiple turns in each of the first direction and a second direction perpendicular or substantially perpendicular to the first direction and whose winding axis extends in the first direction are respectively included, and then calcining the pressure-bonded magnetic layers, wherein the plurality of coil conductors include two specific coil conductors that are adjacent to or in the vicinity of each other in the first direction and that define multiple circles or substantially circular shapes when viewed in the first direction, the two specific coil conductors each include a plurality of partial coil conductors respectively corresponding to a plurality of circles or substantially circular shapes defining the multiple circles or substantially circular shapes, and a circular air gap is defined, at a position sandwiched between the two specific coil conductors when viewed in the second direction, including a width that at least partially overlaps an interval between the plurality of circles or substantially circular shapes defining the multiple circles or substantially circular shapes when viewed in the first direction and extending along the multiple circles or substantially circular shapes. The method includes a first application process in which one of the two specific coil conductors is applied on a magnetic layer, a second application process in which a material to define the air gap is applied on a magnetic layer different from the magnetic layer processed by the first process, a third application process in which the other of the two specific coil conductors is applied on the magnetic layer processed by the second application process, and a preparation process in which a multilayer body before calcination is prepared by laminating the magnetic layer processed by the third application process on the magnetic layer processed by the first application process.

According to a preferred embodiment of the present invention, a laminated coil component includes a multilayer body in which a plurality of magnetic layers are laminated and which includes one main surface and the other main surface; a first outer electrode and a second outer electrode included on the one main surface of the multilayer body; and a coil which is embedded in the multilayer body, and one end of which is connected to the first outer electrode and the other end of which is connected to the second outer electrode, wherein the coil includes a plurality of circular coil conductors respectively included in the plurality of magnetic layers, the plurality of circular coil conductors each include an inner side portion coil conductor and an outer side portion coil conductor, the first outer electrode is connected to the inner side portion coil conductor at the one main surface side, the second outer electrode is connected to the outer side portion coil conductor at the one main surface side, and the inner side portion coil conductor and the outer side portion coil conductor are connected at the other main surface side.

Preferably, a direction of a current flowing through the outer side portion coil conductor is the same or substantially the same as a direction of a current flowing through the inner side portion coil conductor, for example.

Preferably, a circular air gap is defined between two circular coil conductors adjacent to or in the vicinity of each other in a lamination direction while including a width that at least partially overlaps an interval between the inner side portion coil conductor and the outer side portion coil conductor when viewed in the lamination direction and extending along the circular coil conductors.

Preferably, the air gap is defined by a material that vanishes when calcined, for example.

Two specific coil conductors are adjacent to or in the vicinity of each other in the first direction as a lamination direction, and define multiple circles or substantially circular shapes when viewed in the first direction. Further, each of the specific coil conductors includes a plurality of partial coil conductors respectively corresponding to a plurality of circles or substantially circular shapes defining the multiple circles or substantially circular shapes.

An air gap with a circular or substantially circular shape when viewed in the first direction is defined at a position between the two specific coil conductors when viewed in the second direction as a direction perpendicular or substantially perpendicular to the lamination direction. A width of the air gap at least partially overlaps an interval between the plurality of circles or substantially circular shapes defining the multiple circles or substantially circular shapes, and extends along the multiple circles or substantially circular shapes.

The air gap is defined by stacking and pressure-bonding a plurality of magnetic layers, and calcining a raw multilayer body prepared through the stacking and pressure-bonding processing. The plurality of magnetic layers to be stacked and pressure-bonded are provided as follows: a magnetic layer where a material that defines an air gap is applied is sandwiched between two magnetic layers where the two specific coil conductors are respectively applied, or a magnetic layer where a material that defines the air gap and one of the specific coil conductors are applied in that order is placed on a magnetic layer where the other of the specific coil conductors is applied.

The material that defines the air gap is shifted to the interval between the plurality of circles or substantially circular shapes defining the multiple circles or substantially circular shapes at the time of stacking and pressure-bonding. A lack of pressure generated in the interval is at least partially compensated by the shifting of the material that defines the air gap. This makes it possible to alleviate stress strain caused by a difference in thermal expansion coefficients and to significantly reduce or prevent unintended separation of the magnetic layers.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 3A shows outer electrodes located on a nonmagnetic layer L1 as a basic member of the laminated coil component according to the first preferred embodiment of the present invention; FIG. 3B shows a wiring conductor and through-holes included in a magnetic layer L2 as a basic member of the laminated coil component according to the first preferred embodiment of the present invention; FIG. 3C shows a coil conductor and through-holes included in a magnetic layer L3 as a basic member of the laminated coil component according to the first preferred embodiment of the present invention; FIG. 3D shows a carbon paste and through-holes included in a magnetic layer L4 as a basic member of the laminated coil component according to the first preferred embodiment of the present invention; FIG. 3E shows a coil conductor and through-holes included in a magnetic layer L5 as a basic member of the laminated coil component according to the first preferred embodiment of the present invention; FIG. 3F shows a coil conductor and through-holes included in a magnetic layer L6 as a basic member of the laminated coil component according to the first preferred embodiment of the present invention; FIG. 3G shows a coil conductor and through-holes included in a magnetic layer L7 as a basic member of the laminated coil component according to the first preferred embodiment of the present invention; and FIG. 3H shows a carbon paste and through-holes included in a magnetic layer L8 as a basic member of the laminated coil component according to the first preferred embodiment of the present invention.

FIG. 5A shows an enlarged view of the magnetic layer L3 and the magnetic layer L5 superposed in a see-through manner; FIG. 5B shows an enlarged view of the magnetic layer L4; FIG. 5C shows an enlarged view of the magnetic layers L3 to L5 superposed in a see-through manner; FIG. 5D shows an enlarged view of the magnetic layer L7 and the magnetic layer L9 superposed in a see-through manner; FIG. 5E shows an enlarged view of the magnetic layer L8; and FIG. 5F shows an enlarged view of the magnetic layers L7 to L9 superposed in a see-through manner.

FIG. 6A shows a portion of the stacked magnetic layers L3 to L6 or L7 to L10; FIG. 6B shows a portion of the pressure-bonded magnetic layers L3 to L6 or L7 to L10; and FIG. 6C shows a portion of the magnetic layers L3 to L6 or L7 to L10 after calcination.

FIG. 9A shows a portion of the stacked magnetic layers L3, L45, and L6 or L7, L89, and L10; FIG. 9B shows a portion of the pressure-bonded magnetic layers L3, L45, and L6 or L7, L89, and L10; and FIG. 9C shows a portion of the magnetic layers L3, L45, and L6 or L7, L89, and L10 after calcination.

FIG. 10A shows outer electrodes located on the nonmagnetic layer L1 as a basic member of a laminated coil component according to a third preferred embodiment of the present invention of the present invention; FIG. 10B shows a wiring conductor and through-holes included in the magnetic layer L2 as a basic member of the laminated coil component according to the third preferred embodiment of the present invention; FIG. 10C shows a coil conductor and through-holes included in the magnetic layer L3 as a basic member of the laminated coil component according to the third preferred embodiment of the present invention; FIG. 10D shows a coil conductor and through-holes included in the magnetic layer L5 as a basic member of the laminated coil component according to the third preferred embodiment of the present invention; FIG. 10E shows a coil conductor and through-holes included in the magnetic layer L6 as a basic member of the laminated coil component according to the third preferred embodiment of the present invention; and FIG. 10F shows a coil conductor and through-holes included in the magnetic layer L7 as a basic member of the laminated coil component according to the third preferred embodiment of the present invention.

DETAILED DESCRIPTION OF THE PREFERRED EMBODIMENTS

First Preferred Embodiment

Figure 1:
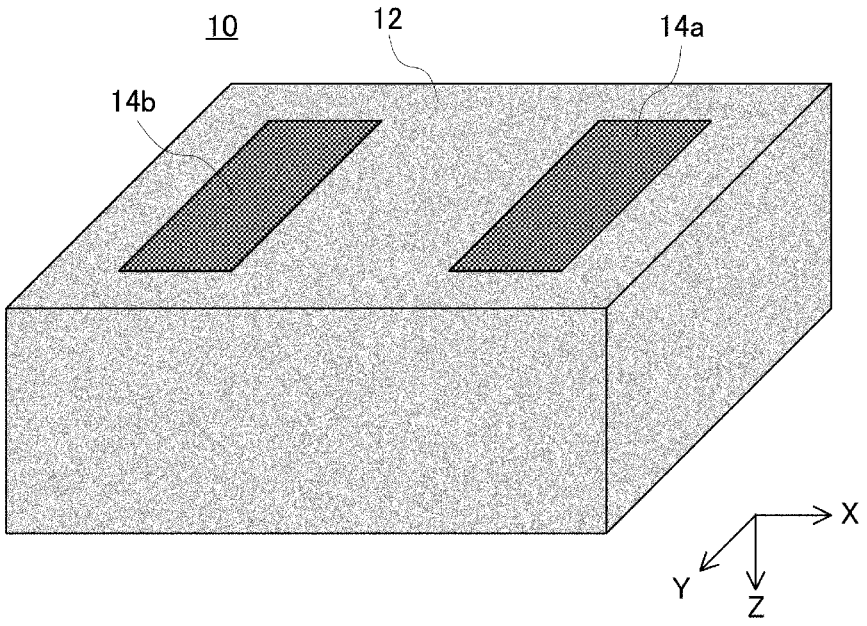
FIG. 1 is a perspective view showing a laminated coil component according to a first preferred embodiment of the present invention obliquely viewed from a lower side.
Figure 2:
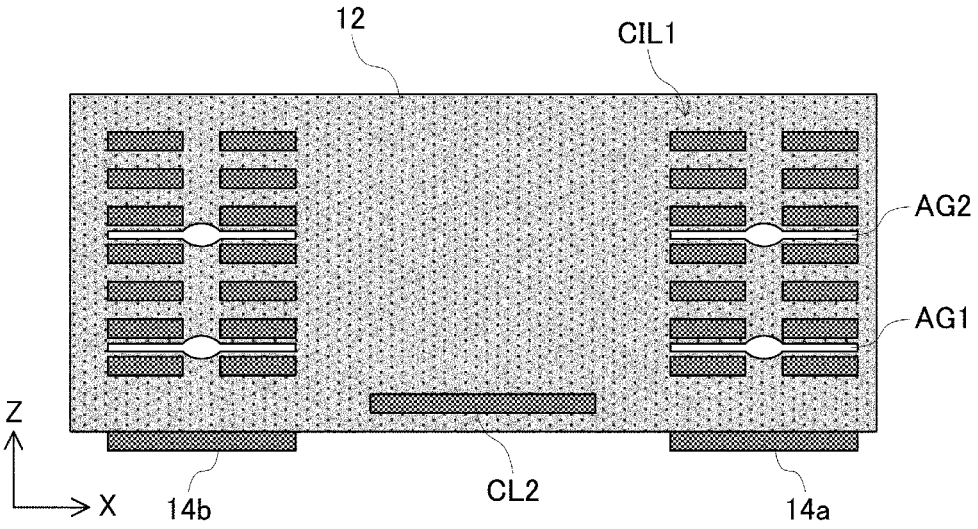
FIG. 2 is a cross-sectional view showing a cross-section of the laminated coil component according to the first preferred embodiment of the present invention.

Referring to FIGS. 1 and 2, a laminated coil component 10 according to a first preferred embodiment of the present invention includes a multilayer body 12 with a rectangular parallelepiped or substantially rectangular parallelepiped shape. A coil CIL1 and a wiring conductor CL2 are embedded inside the multilayer body 12, and air gaps AG1 and AG2 are provided inside the multilayer body 12. In addition, two outer electrodes 14*a* and 14*b* are located on a lower surface of the multilayer body 12, as shown in FIG. 2.

The coil CIL1 is embedded in the multilayer body 12 in which the coil is wound in two turns in a plane direction of the magnetic body layer and in seven turns in the lamination direction, and includes a winding axis that extends in the lamination direction. One end of the coil CIL1 is connected to the outer electrode 14*a* through a via hole conductor (not shown).

The other end of the coil CIL1 is connected to the outer electrode 14*b* through the wiring conductor CL2 and a via hole conductor (not shown). The air gaps AG1 and AG2 are described below.

In the first preferred embodiment, an X axis is assigned to a lengthwise direction of the multilayer body 12, a Y axis is assigned to a width direction of the multilayer body 12, and a Z axis is assigned to a height direction (lamination direction) of the multilayer body 12. A side surface of the multilayer body 12 is perpendicular or substantially perpendicular to the X or Y axis, an upper surface of the multilayer body 12 in FIG. 2 faces to a positive side of the Z axis direction, and a lower surface of the multilayer body 12 in FIG. 2 faces to a negative side of the Z axis direction.

The multilayer body 12 is prepared as follows: the nonmagnetic layer (or feebly magnetic layer) L1, the magnetic layers L2 to L11, and the nonmagnetic layer (or feebly magnetic layer) L12, shown in FIGS. 3A to 3H and FIGS. 4A to 4D, are stacked and pressure-bonded in that order. Next, the multilayer body 12 undergoes calcination, and then the outer electrodes 14*a* and 14*b* are plated. A preparation process of the multilayer body 12 is specifically described as follows. In general, the multilayer body 12 is defined by a multilayer body in a collective board including a plurality of laminated coil components 10, and the multilayer body in the collective board is then divided into individual entities so as to obtain each individual multilayer body 12. However, for the sake of convenience of explanation, a preparation process of a single multilayer body 12 is described below.

The nonmagnetic layers L1 and L12 each include a Cu—Zn based nonmagnetic ferrite as a main ingredient. The magnetic layers L2 to L11 each include a Ni—Cu—Zn or Ni—Mn based magnetic ferrite as a main ingredient.

Prior to lamination, the outer electrodes 14*a* and 14*b* are applied on a lower surface of the nonmagnetic layer L1 as shown in FIG. 3, and the wiring conductor CL2 is applied on an upper surface of the magnetic layer L2 as shown in FIG. 3. Coil conductors CP3, CP5 to CP7, and CP9 to CP11 defining the coil CIL1 are respectively applied on upper surfaces of the magnetic layers L3, L5 to L7, and L9 to L11. Carbon pastes CB4 and CB8, as an example of the material that defines the air gap, are respectively applied on upper surfaces of the magnetic layers L4 and L8 in as shown FIG. 3. The nonmagnetic layer L1, the magnetic layers L2 to L11, and the nonmagnetic layer L12 are stacked in that order and pressure-bonded in the Z axis direction to prepare a multilayer body before calcination is prepared. The multilayer body 12 is completed by calcining the multilayer body prepared as discussed above and performing plating.

The coil conductors CP3, CP5 to CP7, and CP9 to CP11, and the wiring conductor CL2 are defined by screen printing of an electrode paste whose main ingredient is Ag, Ag—Pd, Ag—Pt, Cu, Au, Pt, Al, or the like. The carbon pastes CB4 and CB8 are formed by screen printing of a slurry whose main ingredient is carbon.

When the multilayer body 12 is viewed in the Z axis direction, the coil conductors CP3, CP5 to CP7, and CP9 to CP10 at least partially overlap with each other and define two circles. The term "circle" should be understood to include both circles and substantially circular shapes. Even with respect to only the coil conductors CP3 and CP5 adjacent to or in the vicinity of each other in the Z axis direction, the coil conductors CP3 and CP5 define two circles when viewed in the Z axis direction, as shown, for example, in FIG. 5A. Even with respect to only the coil conductors CP7 and CP9 adjacent to or in the vicinity of each other in the Z axis direction, the coil conductors CP7 and CP9 define two circles when viewed in the Z axis direction, as shown, for example, in FIG. 5D.

As shown in FIG. 3C, the coil conductor CP3 includes two partial coil conductors CP3*a* and CP3*b* respectively corresponding to an outer side portion circle and an inner side portion circle defining the two circles and including the same or substantially the same width. As shown in FIG. 3E, the coil conductor CP5 includes two partial coil conductors CP5*a* and CP5*b* respectively corresponding to the outer side portion circle and the inner side portion circle defining the two circles and including the same or substantially the same width.

As shown in FIG. 3F, the coil conductor CP6 includes two partial coil conductors CP6*a* and CP6*b* respectively corresponding to the outer side portion circle and the inner side portion circle defining the two circles and including the same or substantially the same width. As shown in FIG. 3G, the coil conductor CP7 includes two partial coil conductors CP7*a* and CP7*b* respectively corresponding to the outer side portion circle and the inner side portion circle defining the two circles and including the same or substantially the same width.

Figure 4A:
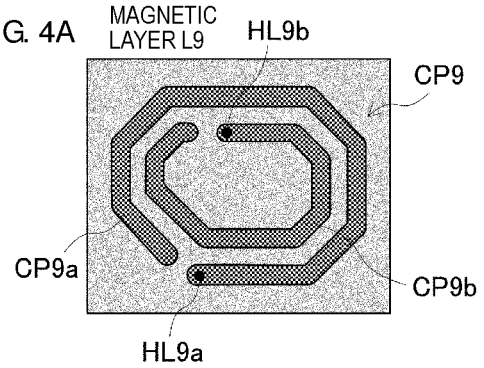
FIG. 4A shows a coil conductor and through-holes included in a magnetic layer L9 as a basic member of the laminated coil component according to the first preferred embodiment of the present invention.

As shown in FIG. 4A, the coil conductor CP9 includes two partial coil conductors CP9*a* and CP9*b* respectively corresponding to the outer side portion circle and the inner side portion circle defining the two circles and including the same or substantially the same width. As shown in FIG. 4B, the coil conductor CP10 includes two partial coil conductors CP10*a* and CP10*b* respectively corresponding to the outer side portion circle and the inner side portion circle defining the two circles and including the same or substantially the same width.

Figure 4C:
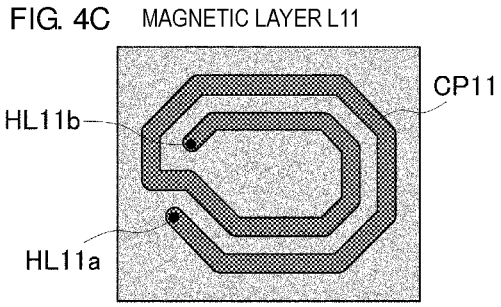
FIG. 4C shows a coil conductor and through-holes included in a magnetic layer L11 as a basic member of the laminated coil component according to the first preferred embodiment of the present invention.
Figure 4B:
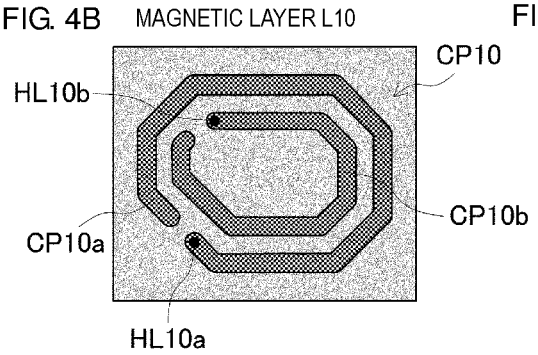
FIG. 4B shows a coil conductor and through-holes included in a magnetic layer L10 as a basic member of the laminated coil component according to the first preferred embodiment of the present invention.
Figure 4D:
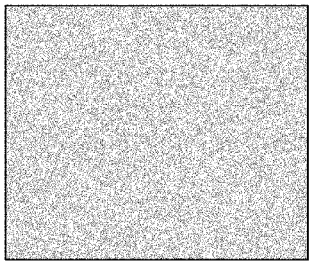
FIG. 4D shows a nonmagnetic layer L12 as a basic member of the laminated coil component according to the first preferred embodiment of the present invention.

As shown in FIG. 4C, the coil conductor CP11 defines a double-spiral shape when viewed in the Z axis direction. When viewed in the Z axis direction, a portion of the spiral shape at least partially overlaps with the outer side portion circle defining the two circles while another portion of the spiral shape at least partially overlaps with the inner side portion circle defining the two circles.

The outer electrode 14*a* is connected to one end of the partial coil conductor CP3*a* through via hole conductors HL1*a*, HL2*a*, and HL3*a* included in the nonmagnetic layer L1, the magnetic layer L2, and the magnetic layer L3, respectively. The other end of the partial coil conductor CP3*a* is connected to one end of the partial coil conductor CP5*a* through via hole conductors HL4*a* and HL5*a* included in the magnetic layers L4 and L5, respectively.

The other end of the partial coil conductor CP5*a* is connected to one end of the partial coil conductor CP6*a* through a via hole conductor HL6*a* included in the magnetic layer L6. The other end of the partial coil conductor CP6*a* is connected to one end of the partial coil conductor CP7*a* through a via hole conductor HL7*a* included in the magnetic layer L7.

The other end of the partial coil conductor CP7*a* is connected to one end of the partial coil conductor CP9*a* through via hole conductors HL8*a* and HL9*a* included in the magnetic layers L8 and L9, respectively. The other end of the partial coil conductor CP9*a* is connected to one end of the partial coil conductor CP10*a* through a via hole conductor HL10*a* included in the magnetic layer L10. The other end of the partial coil conductor CP10*a* is connected to one end of the coil conductor CP11 through a via hole conductor HL11*a* included in the magnetic layer L11.

The other end of the coil conductor 11 is connected to one end of the partial coil conductor CP10*b* through a via hole conductor HL11*b* included in the magnetic layer L11. The other end of the partial coil conductor CP10*b* is connected to one end of the partial coil conductor CP9*b* through a via hole conductor HL10*b* included in the magnetic layer L10. The other end of the partial coil conductor CP9*b* is connected to one end of the partial coil conductor CP7*b* through via hole conductors HL9*b* and HL8*b* included in the magnetic layers L9 and L8, respectively.

The other end of the partial coil conductor CP7*b* is connected to one end of the partial coil conductor CP6*b* through a via hole conductor HL7*b* included in the magnetic layer L7. The other end of the partial coil conductor CP6*b* is connected to one end of the partial coil conductor CP5*b* through a via hole conductor HL6*b* included in the magnetic layer L6. The other end of the partial coil conductor CP5*b* is connected to one end of the partial coil conductor CP3*b* through via hole conductors HL5*b* and HL4*b* included in the magnetic layers L5 and L4, respectively.

The other end of the partial coil conductor CP3*b* is connected to one end of the wiring conductor CL2 through a via hole conductor HL3*b* included in the magnetic layer L3. The other end of the wiring conductor CL2 is connected to the outer electrode 14*b* through via hole conductors HL2*b* and HL1*b* included in the magnetic layer L2 and the nonmagnetic layer L1, respectively.

As discussed above, the coil CIL1 is wound in a direction from the partial coil conductor CP3*a* toward the coil conductor CP11, and the coil CIL1 is wound in a direction reverse to the direction from the coil conductor CP11 toward the partial coil conductor CP3*b*, thus defining the single coil CIL1.

The via hole conductors HL1*a* to HL11*a* and HL1*b* to HL11*b* are formed by filling a conductive paste whose main ingredient is Ag, Ag—Pd, Ag—Pt, Cu, Au, Pt, Al, or the like and calcining the paste in a calcination process.

Referring to FIGS. 5A to 5C, the carbon paste CB4 included on the magnetic layer L4 defines a single circle along the two circles defined by the coil conductors CP3 and CP5 when viewed in the Z axis direction. A width of this single circle at least partially overlaps an interval between the outer side portion circle and inner side portion circle defining the two circles excluding an area adjacent to or in the vicinity of the via hole conductor HL4*a* and an area adjacent to or in the vicinity of the via hole conductor HL4*b*. To be more specific, an outer circumference edge of the single circle extends circularly on the outer side portion circle excluding an area adjacent to or in the vicinity of the via hole conductor HL4*a*. An inner circumference edge of the single circle extends circularly on the inner side portion circle excluding an area adjacent to or in the vicinity of the via hole conductor HL4*b*.

Further, referring to FIGS. 5D to 5F, the carbon paste CB8 included on the magnetic layer L8 defines a single circle along the two circles defined by the coil conductors CP7 and CP9 when viewed in the Z axis direction. A width of the single circle at least partially overlaps an interval between the outer side portion circle and inner side portion circle defining the two circles excluding an area adjacent to or in the vicinity of the via hole conductor HL8*a* and an area adjacent to or in the vicinity of the via hole conductor HL8*b*. To be more specific, an outer circumference edge of the single circle extends circularly on the outer side portion circle excluding an area adjacent to or in the vicinity of the via hole conductor HL8*a*. An inner circumference edge of the single circle extends circularly on the inner side portion circle excluding an area adjacent to or in the vicinity of the via hole conductor HL8*b*.

FIG. 6A illustrates a cross-section of a portion of the stacked magnetic layers L3 to L6 or L7 to L10 when viewed from a positive side of the Y axis direction. The cross-section corresponds to a section enclosed by a broken line in FIG. 5C or 5F. The magnetic layer L6 or L10 is also shown in FIG. 6A.

When viewed in the Z axis direction, the carbon paste CB4 is also included in an interval region which corresponds to a gap between the partial coil conductors CP3*a* and CP3*b* or a gap between the partial coil conductors CP5*a* and CP5*b*, in addition to conductor regions where the partial coil conductors CP3*a* and CP3*b* or the partial coil conductors CP5*a* and CP5*b* are present.

The carbon paste CB8 is also included in an interval region which corresponds to a gap between the partial coil conductors CP7*a* and CP7*b* or between the partial coil conductors CP9*a* and CP9*b*, in addition to conductor regions where the partial coil conductors CP7*a* and CP7*b* or the partial coil conductors CP9*a* and CP9*b* are present.

When the stacked magnetic layers L3 to L6 or L7 to L10 are pressure-bonded, thicknesses of the partial coil conductors CP3*a* to CP3*b* and CP5*a* to CP5*b*, or thicknesses of the partial coil conductors CP7*a* to CP7*b* and CP9*a* to CP9*b* cause the carbon paste CB4 or CB8 to shift to the interval region, as shown, for example, in FIG. 6B. In other words, the carbon paste CB4 or CB8 contracts in the vertical direction in the conductor regions while it expands in the vertical direction in the interval region.

When the pressure-bonded magnetic layers L3 to L6 or L7 to L10 are calcined, the carbon paste CB4 or CB8 vanishes to define the air gap AG1 or AG2, as shown, for example, in FIG. 6C. As shown in FIG. 2, the air gap AG1 is provided between the first turn and the second turn of the coil CIL1, and the air gap AG2 is provided between the fourth turn and the fifth turn of the coil CIL1.

The coil CIL1 is wound in two turns in the X or Y axis direction and in seven turns in the Z axis direction. The winding axis of the coil CIL1 extends in the Z axis direction. The coil conductors CP3, CP5 to CP7, and CP9 to CP11 defining the coil CIL1 are included in the magnetic layers L3, L5 to L7, and L9 to L11, respectively. The multilayer body 12 is defined as follows: the nonmagnetic layer L1, the magnetic layers L2 to L11, and the nonmagnetic layer 12 are stacked and pressure-bonded in the vertical direction, the multilayer body 12 is calcined, and the outer electrodes 14*a* and 14*b* are plated.

The coil conductors CP3 and CP5 are adjacent to or in the vicinity of each other in the vertical direction and define two circles when viewed in the vertical direction. The coil conductors CP7 and CP9 are also adjacent to or in the vicinity of each other in the vertical direction and define two circles when viewed in the vertical direction.

The coil conductor CP3 includes the partial coil conductors CP3*a* and CP3*b* respectively corresponding to the outer side portion circle and inner side portion circle defining the two circles, and the coil conductor CP5 includes the partial coil conductors CP5*a* and CP5*b* respectively corresponding to the outer side portion circle and inner side portion circle defining the two circles.

The coil conductor CP7 includes the partial coil conductors CP7*a* and CP7*b* respectively corresponding to the outer side portion circle and inner side portion circle defining the two circles, and the coil conductor CP9 includes the partial coil conductors CP9*a* and CP9*b* respectively corresponding to the outer side portion circle and inner side portion circle defining the two circles.

The air gap AG1 is defined at a position sandwiched between the coil conductors CP3 and CP5 when viewed in the X or Y axis direction. The air gap AG2 is defined at a position sandwiched between the coil conductors CP7 and CP9 when viewed in the X or Y axis direction. A width of each of the air gaps AG1 and AG2 at least partially overlaps an interval between the outer side portion circle and inner side portion circle defining the two circles, and circularly extends along the two circles.

The coil conductors CP3, CP5, CP7, and CP9 are applied on the magnetic layers L3, L5, L7, and L9, respectively, in the first application process. The carbon pastes CB4 and CB8 are applied on the magnetic layers L4 and L8, respectively, in the second application process. When the first application process and the second application process are finished, the preparation process is performed, in which the magnetic layer L4 is inserted between the magnetic layers L3 and L5, and the magnetic layer L8 is inserted between the magnetic layers L7 and L9. The multilayer body 12 is prepared by pressure-bonding the nonmagnetic layer L1, the magnetic layers L2 to L11, and the nonmagnetic layer L12 stacked as discussed above, calcining the pressure-bonded magnetic layers, and plating the outer electrodes 14*a* and 14*b*.

The carbon paste CB4 or CB8 is shifted to an interval between the outer side portion circle and inner side portion circle defining the two circles at the time of stacking and pressure-bonding. A lack of pressure generated in the interval is at least partially compensated by the shifting of the carbon paste CB4 or CB8. This makes it possible to significantly reduce or prevent unintended separation of the nonmagnetic layer L1, the magnetic layers L2 to L11, and the nonmagnetic layer L12.

Second Preferred Embodiment

Figure 7:
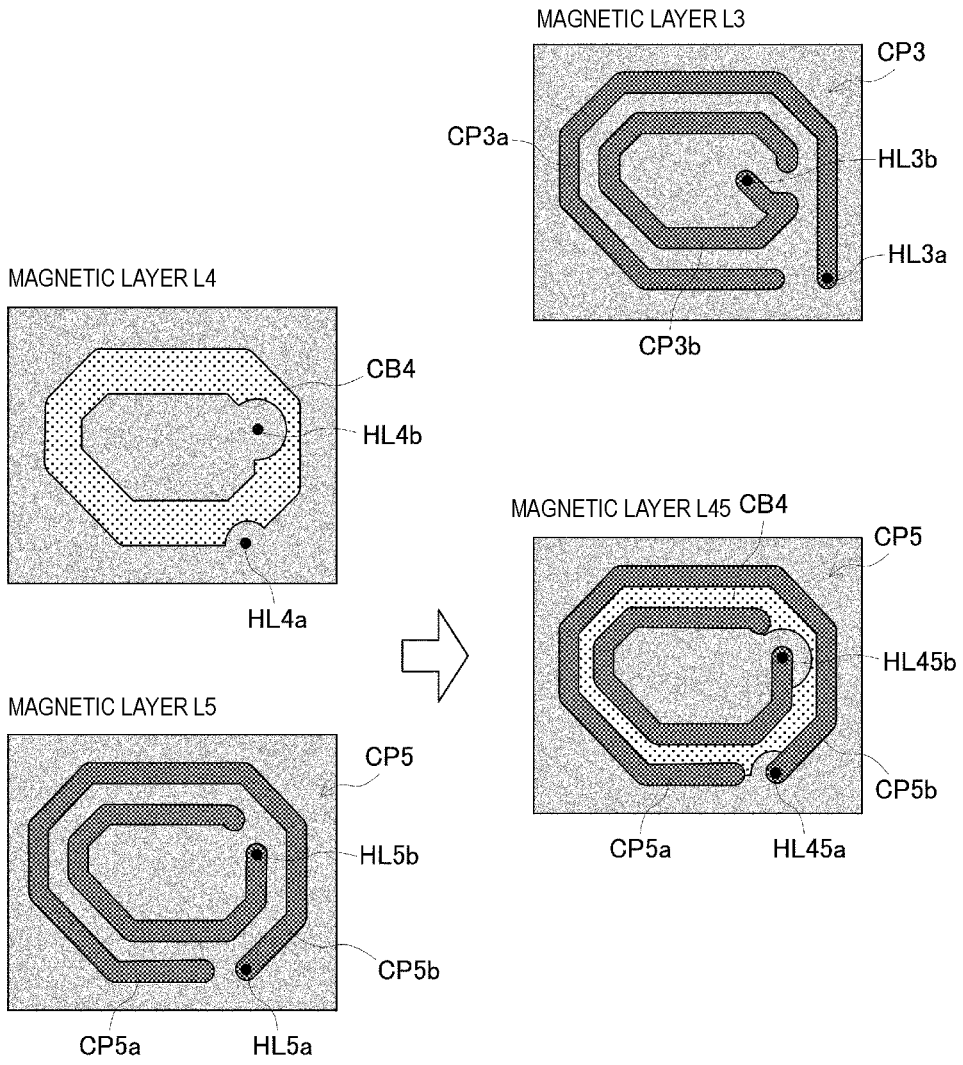
FIG. 7 shows a portion of a preparation process of the magnetic layer L3 and a magnetic layer L45 defining a laminated coil component according to a second preferred embodiment of the present invention.
Figure 8:
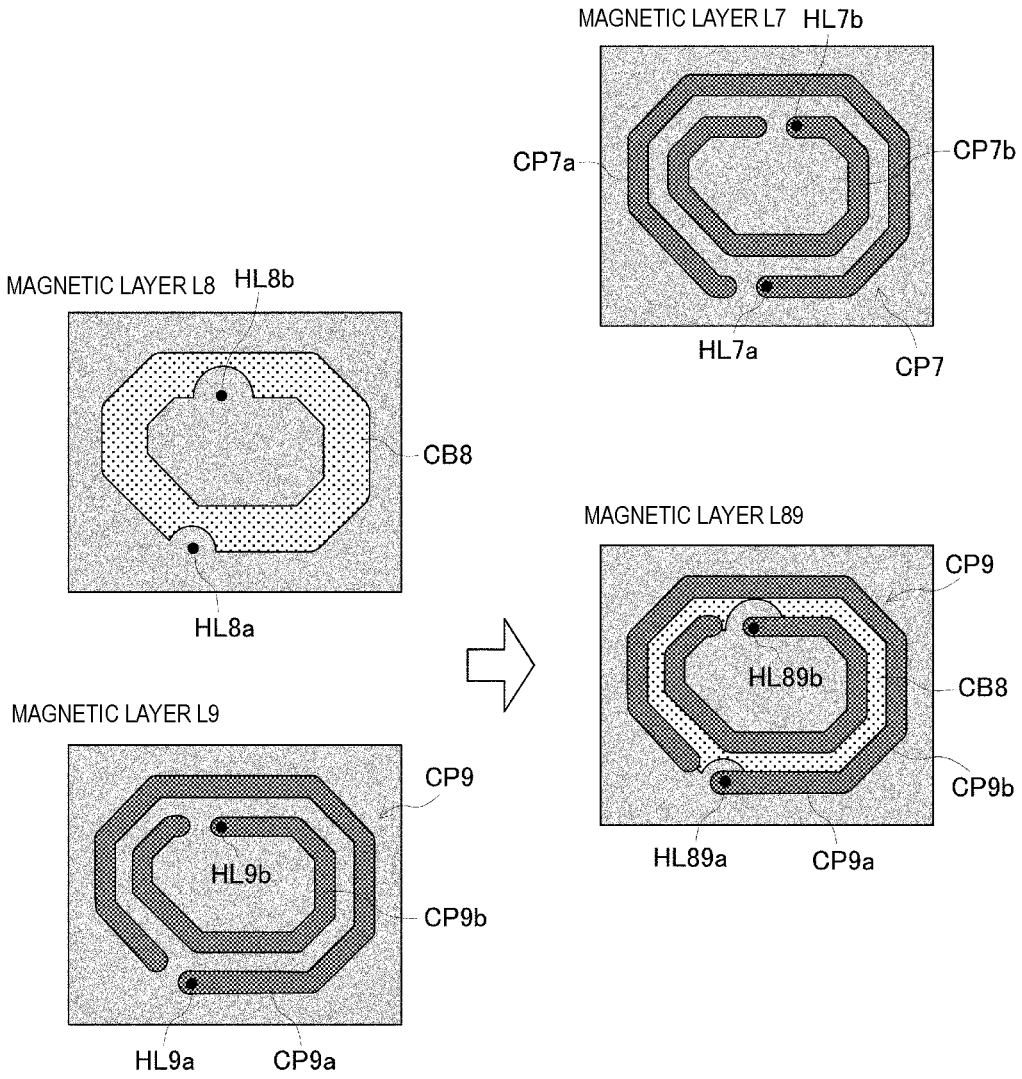
FIG. 8 shows a portion of a preparation process of the magnetic layer L7 and a magnetic layer L89 defining the laminated coil component according to the second preferred embodiment of the present invention.
Figure 11A:
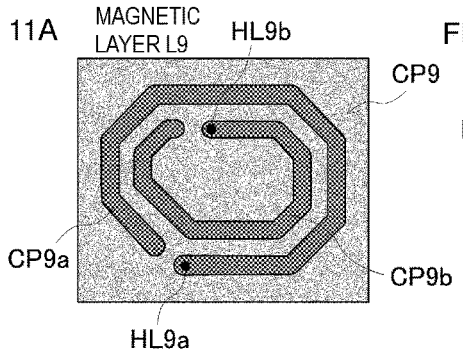
FIG. 11A shows a coil conductor and through-holes included in the magnetic layer L9 as a basic member of the laminated coil component according to the third preferred embodiment of the present invention.
Figure 11C:
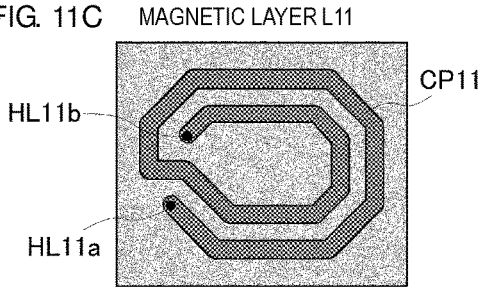
FIG. 11C shows a coil conductor and through-holes included in the magnetic layer L11 as a basic member of the laminated coil component according to the third preferred embodiment of the present invention.
Figure 11B:
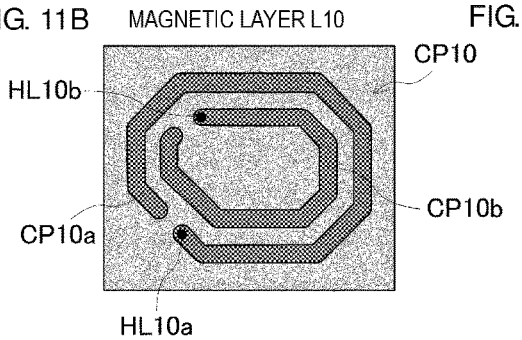
FIG. 11B shows a coil conductor and through-holes included in the magnetic layer L10 as a basic member of the laminated coil component according to the third preferred embodiment of the present invention.
Figure 11D:
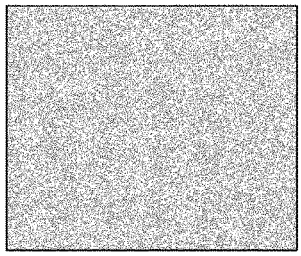
FIG. 11D shows the nonmagnetic layer L12 as a basic member of the laminated coil component according to the third preferred embodiment of the present invention.
Figure 12:
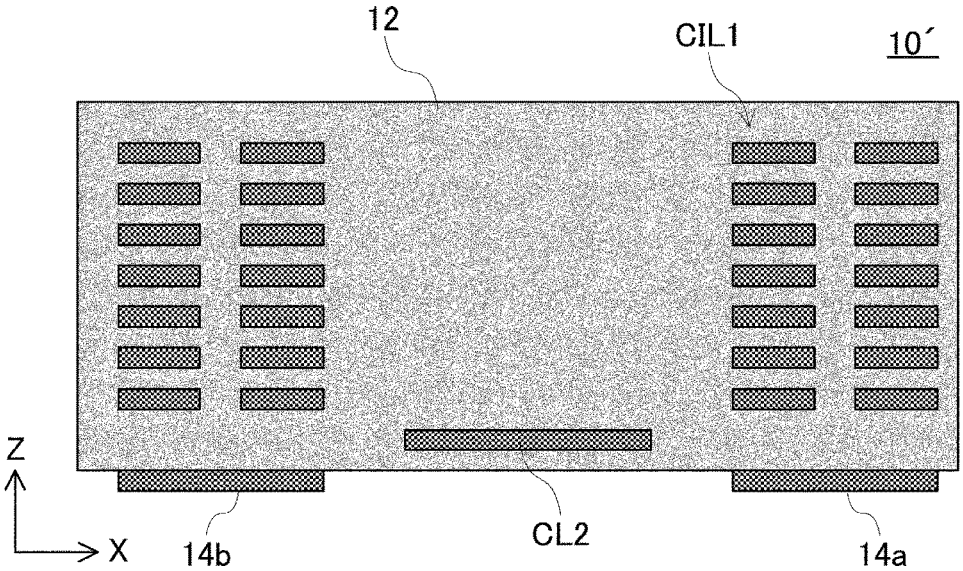
FIG. 12 shows a cross-section of the laminated coil component according to the third preferred embodiment of the present invention.

In the first preferred embodiment, the carbon pastes CB4 and CB8 are applied on the magnetic layers L4 and L8, respectively, and the coil conductors CP5 and CP9 are applied on the magnetic layers L5 and L9, respectively. In a second preferred embodiment of the present invention, as shown in FIGS. 7 and 8, the carbon paste CB4 and the coil conductor C5 are applied on a shared magnetic layer L45 in that order, and the carbon paste CB8 and the coil conductor CP9 are applied on a shared magnetic layer L89 in that order.

The coil conductor CP3 is applied on the magnetic layer L3 and the coil conductor CP7 is applied on the magnetic layer L7. On the magnetic layers L45 and L89, the carbon pastes CB4 and CB8 are respectively applied first, and then the coil conductors CP5 and CP9 are respectively applied. When these processes are finished, the magnetic layer L45 is laminated on the magnetic layer L3 and the magnetic layer L89 is laminated on the magnetic layer L7 to prepare a multilayer body before calcination. The multilayer body is calcined and the outer electrodes 14*a* and 14*b* are plated to complete multilayer body 12.

FIG. 9A illustrates a portion of the stacked magnetic layers L3, L45, and L6 or L7, L89, and L10 when viewed from the positive side of the Y axis direction. When viewed in the Z axis direction, the carbon paste CB4 is also included in an interval region which corresponds to a gap between the partial coil conductors CP3*a* and CP3*b* or a gap between the partial coil conductors CP5*a* and CP5*b*, in addition to conductor regions where the partial coil conductors CP3*a* and CP3*b* or the partial coil conductors CP5*a* and CP5*b* are present.

The carbon paste CB8 is also included in an interval region which corresponds to a gap between the partial coil conductors CP7*a* and CP7*b* or between the partial coil conductors CP9*a* and CP9*b*, in addition to conductor regions where the partial coil conductors CP7*a* and CP7*b* or the partial coil conductors CP9*a* and CP9*b* are present.

When the stacked magnetic layers L3, L45, and L6 or L7, L89, and L10 are pressure-bonded, thicknesses of the partial coil conductors CP3*a* to CP3*b* and CP5*a* to CP5*b*, or thicknesses of the partial coil conductors CP7*a* to CP7*b* and CP9*a* to CP9*b* bring an effect to cause the carbon paste CB4 or CB8 to shift to the interval region, as shown, for example, in FIG. 9B. In other words, the carbon paste CB4 or CB8 contracts in the vertical direction in the conductor regions while it expands in the vertical direction in the interval region. When the pressure-bonded magnetic layers L3, L45, and L6 or L7, L89, and L10 are calcined, the carbon paste CB4 or CB8 vanishes to define the air gap AG1 or AG2, as shown, for example, in FIG. 9C.

Also in the second preferred embodiment, the carbon paste CB4 or CB8 is shifted to the interval between the outer side portion circle and inner side portion circle defining the two circles at the time of stacking and pressure-bonding. A lack of pressure generated in the interval is at least partially compensated by the shifting of the carbon paste CB4 or CB8. This makes it possible to significantly reduce or prevent unintended separation of the nonmagnetic layer L1, the magnetic layers L2 to L3, L45, L6 to L7, L89, L10 to L11, and the nonmagnetic layer L12.

Although a single-channel laminated coil component is preferably included in the first preferred embodiment and the second preferred embodiment, preferred embodiments of the present invention are able to be applied to a multiple-channel laminated coil component in which a plurality of coils are embedded in a multilayer body. Further, in the first preferred embodiment, the carbon pastes CB4 and CB8 are included in the magnetic layers L4 and L8, respectively. However, according to preferred embodiments of the present invention, the positions and the number of materials that define the air gap, for example, carbon pastes or the like, are able to be appropriately adjusted in consideration of the number of magnetic layers defining the multilayer body.

Preferably, the material that defines the air gap is not included in an outer side portion region located beyond the outermost outer side portion circle, for example. If the material that defines the air gap is located in the outer side portion region, a crack is more likely to be generated, starting in the outer side portion, when the material that defines the air gap vanishes to define an air gap. However, in the first preferred embodiment and the second preferred embodiment, if the material that defines the air gap is located within an inner side portion region relative to the outer side portion circle, the generation of an air gap in an outer side portion relative to the outer side portion circle at the time of pressure-bonding due to a pressure applied in the lamination direction is significantly reduced or prevented. Thus, the generation of an undesired crack is significantly reduced or prevented.

In the first preferred embodiment and the second preferred embodiment, although the coil CIL1 is defined by the coil conductors included the outer side portion circle and inner side portion circle providing the two circles, multiple circles (that is, three or more circles) may be included. The advantages of preferred embodiments of the present invention are able to be obtained if the circular air gaps include a width at least partially overlapping each interval between a plurality of circles defining the multiple circles and extend along the multiple circles.

Further, although the carbon paste preferably is used as a material that defines the air gap in the first and second preferred embodiments, the material that defines the air gap is not limited thereto as long as the material vanishes through a calcination process. For example, the material that defines the air gap may include a paste of resin beads.

Third Preferred Embodiment

Referring to FIGS. 10A to 10F, FIGS. 11A to 11D, and FIG. 12, a laminated coil component 10' according to a third preferred embodiment of the present invention is the same or substantially the same as the laminated coil component 10 according to the first preferred embodiment except a point that the magnetic layer L4 shown in FIG. 3D and the magnetic layer L8 shown in FIG. 3H are omitted.

In any of the laminated coil components 10 and 10', there are prepared a plurality of magnetic layers including the magnetic layers L3, L5 to L7, and L9 to L10, and the multilayer body 12 is defined by laminating these magnetic layers.

The outer electrode 14*a* and the outer electrode 14*b* are included on one main surface of the multilayer body 12. Inside the multilayer body 12, the coil CIL1 is embedded. One end and the other end of the coil CIL1 are connected to the outer electrodes 14*a* and 14*b*, respectively. The coil CIL1 is defined by the circular coil conductors CP3, CP5 to CP7, and CP9 to CP10 included in the magnetic layers L3, L5 to L7, and L9 to L10, respectively, and the spiral-shaped coil conductor CP11 included in the magnetic layer L11.

The coil conductor CP3 includes the partial coil conductors CP3*a* and CP3*b*, the coil conductor CP5 includes the partial coil conductors CP5*a* and CP5*b*, and the coil conductor CP6 includes the partial coil conductors CP6*a* and CP6*b*. The coil conductor CP7 includes the partial coil conductors CP7*a* and CP7*b*, the coil conductor CP9 includes the partial coil conductors CP9*a* and CP9*b*, and the coil conductor CP10 includes the partial coil conductors CP10*a* and CP10*b*.

The partial coil conductors CP3*a*, CP5*a* to CP7*a*, and CP9*a* to CP10*a* respectively define the outer side portion coil conductor, and the partial coil conductors CP3*b*, CP5*b* to CP7*b*, and CP9*b* to CP10*b* respectively define the inner side portion coil conductor.

The outer electrode 14*a* is connected to the partial coil conductor CP3*a* or the outer side portion coil conductor at the one main surface side of the multilayer body 12 through the via hole conductors HL1*a*, HL2*a*, and HL3*a* included in the nonmagnetic layer L1, the magnetic layer L2, and the magnetic layer L3, respectively. The outer electrode 14*b* is connected to the partial coil conductor CP3*b*, or the inner side portion coil conductor at the one main surface side of the multilayer body 12 through the via hole conductors HL1*b*, HL2*b*, and HL3*b* included in the nonmagnetic layer L1, the magnetic layer L2, and the magnetic layer L3, respectively, and the wiring conductor CL2. Further, the partial coil conductor 10*a*, or the outer side portion conductor is connected to the partial coil conductor 10*b*, or the inner side portion coil conductor at the other main surface side of the multilayer body 12 through the coil conductor CP11.

Figure 13:
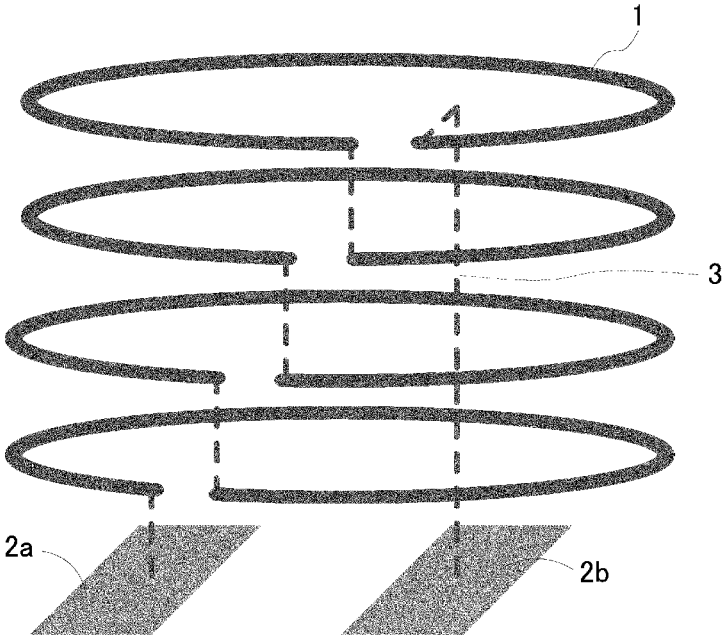
FIG. 13 shows a comparative example of an inner structure of a laminated coil component.

In a laminated coil component of a comparative example, a coil device 1 embedded in a multilayer body is connected to outer electrodes 2*a* and 2*b* as shown in FIG. 13. That is, although one end of the coil device 1 is disposed near the outer electrode 2*a*, the other end of the coil device 1 is disposed being distanced from the outer electrode 2*b*. Because of this, the other end of the coil device 1 is connected to the outer electrode 2*b* through a via hole conductor 3 extending relatively a long distance along a winding axis of the coil device 1.

However, in the comparative example, the via hole conductor 3 interferes with generation of a magnetic field by the coil device 1. In order to generate a more ideal magnetic field, the diameter of the coil device 1 would need to be lengthened, for example.

Figure 14:
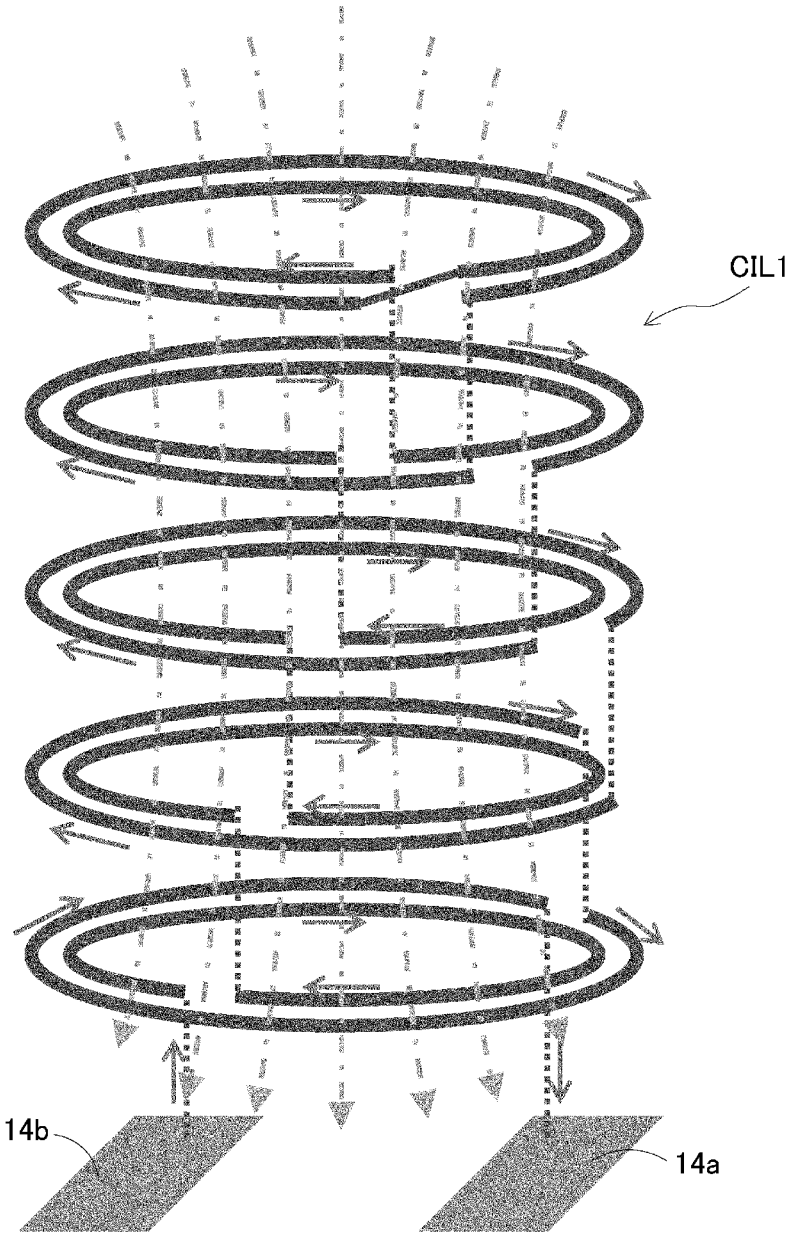
FIG. 14 shows an example of a magnetic field generated by the laminated coil component according to the third preferred embodiment of the present invention.

In consideration of the issue discussed above, in the first or third preferred embodiment, the coil CIL1 is connected to the outer electrodes 14*a* and 14*b* as shown in FIG. 14. According to FIG. 14, the outer side portion coil conductor and the inner side portion coil conductor are connected to the outer electrodes 14*a* and 14*b* at the one main surface side of the multilayer body 12, and connected to each other at the other main surface side of the multilayer body 12.

Accordingly, the via hole conductor does not need to extend a relatively long distance along the winding axis of the coil CIL1 to provide an ideal or substantially ideal magnetic field. In addition, the via hole conductors to connect two partial coil conductors adjacent to or in the vicinity of each other in the lamination direction at least partially overlap with each of the outer side portion coil conductor and the inner side portion coil conductor in plan view. As a result, an ideal or substantially ideal magnetic field is able to be generated without increasing the diameter of the coil CIL1.

In particular, according to the connection structure shown in FIG. 14, because the direction of a current flowing through the inner side portion coil conductor is the same or substantially the same as the direction of a current flowing through the outer side portion coil conductor, the magnetic field is able to be strengthened.

A magnetic field generated in the outer side portion coil conductor and a magnetic field generated in the inner side portion coil conductor may cancel out each other in a region between the outer side portion coil conductor and the inner side portion coil conductor, which raises a risk of the inductance value of the coil CIL1 becoming unstable.

However, the risk discussed above is lowered or eliminated by defining the air gaps AG1 and AG2 as in the first preferred embodiment. In other words, defining the air gaps AG1 and AG2 makes it difficult for a magnetic field to be generated in a region between the outer side portion coil conductor and the inner side portion coil conductor, and the inductance value of the coil CIL1 is able to be stabilized at or in the vicinity of the design value.

Preferred embodiments of the present invention are able to be applied not only to a closed magnetic circuit laminated coil component in which all the layers except the lowermost and uppermost layers include magnetic layers like in the first through third preferred embodiments, but also to an open magnetic circuit laminated coil component in which a portion of a plurality of layers sandwiched between the lowermost and upper most layers includes a nonmagnetic layer. Further, the preferred embodiments of the present invention are also able to be applied to an LGA (land grid array) laminated coil component in which a wiring pattern is located on a surface of the multilayer body. In particular, by mounting an IC chip, a chip capacitor, or the like on an upper surface of a laminated coil component, a module component such as a micro DC-DC converter is able to be included, for example.

Fourth Preferred Embodiment

Figure 15A:
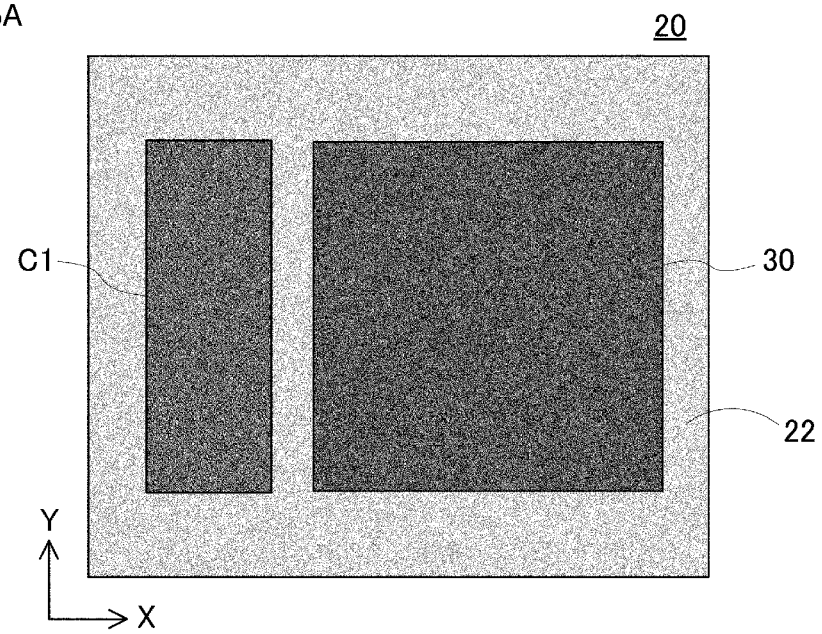
FIG. 15A is a top view showing an example of a laminated coil component according to a fourth preferred embodiment of the present invention viewed from above.
Figure 15B:
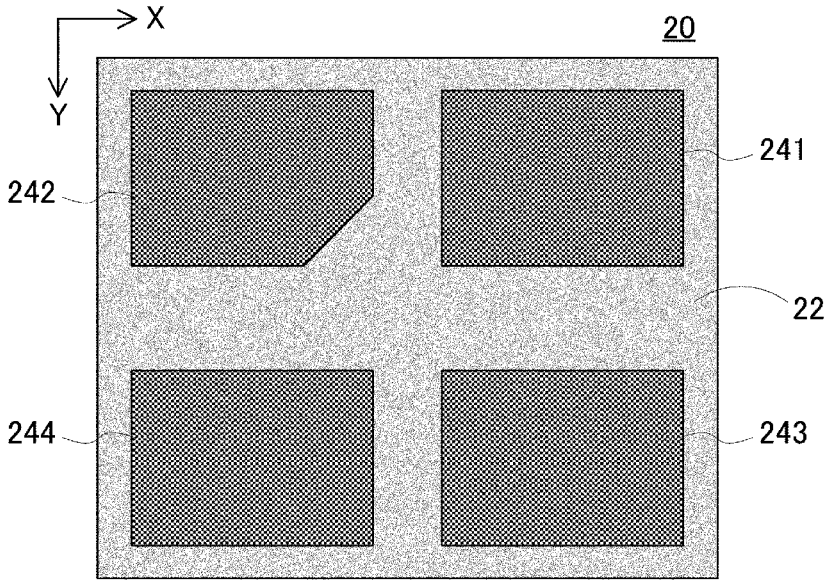
FIG. 15B is a bottom view showing an example of the laminated coil component according to the fourth preferred embodiment of the present invention viewed from the lower side.
Figure 16:
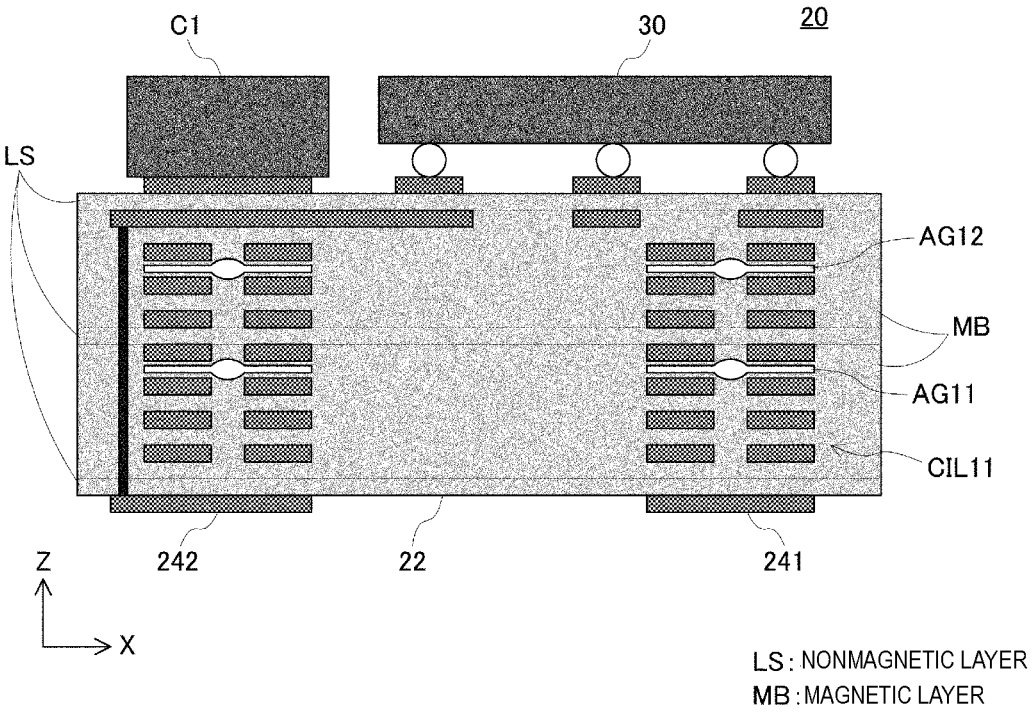
FIG. 16 shows a cross-section of the laminated coil component according to the fourth preferred embodiment of the present invention.

Referring to FIGS. 15A to 15B and FIG. 16, a laminated coil component 20 according to a fourth preferred embodiment of the present invention is an LGA laminated coil component and includes a multilayer body 22 including a rectangular parallelepiped or substantially rectangular parallelepiped shape. FIG. 15A illustrates the laminated coil component 20 viewed from above, FIG. 15B illustrates the laminated coil component 20 viewed from the lower side, and FIG. 16 illustrates a cross-section of the laminated coil component against the width direction.

Inside the multilayer body 22, a coil CIL11, inner wiring conductors to be explained later, and via hole conductors are embedded, and further air gaps AG11 and AG12 are defined.

Outer wiring conductors to be explained later are included on an upper surface of the multilayer body 22, and four outer electrodes 241 to 244 are included on a lower surface of the multilayer body 22. A capacitor C1 and a DC-DC converter IC 30 are mounted on the upper surface of the multilayer body 22 and connected to the outer wiring conductors.

The coil CIL11 is embedded in the multilayer body 22 in which the coil is wound in two turns in a plane direction of the magnetic body layer and in seven turns in the lamination direction, and includes a winding axis that extends in the lamination direction. The connection relationship between the coil CIL11 and the capacitor C1, the DC-DC converter IC 30, and the outer electrodes 241 to 244, and the air gaps AG11 to AG12 are described below.

In the fourth preferred embodiment, the X axis is assigned to a lengthwise direction of the multilayer body 22, the Y axis is assigned to a width direction of the multilayer body 22, and the Z axis is assigned to a height direction (lamination direction) of the multilayer body 22. A side surface of the multilayer body 22 is perpendicular or substantially perpendicular to the X or Y axis, the upper surface of the multilayer body 22 faces to the positive side of the Z axis direction, and the lower surface of the multilayer body 22 faces to the negative side of the Z axis direction.

The multilayer body 22 is prepared as follows: a nonmagnetic layer (or feebly magnetic layer) L21, magnetic layers L22 to L26, a nonmagnetic layer (or feebly magnetic layer) L27, magnetic layers L28 to L32, and a nonmagnetic layer (or feebly magnetic layer) L33, shown in FIGS. 17A to 17H and FIGS. 18A to 18F, are stacked and pressure-bonded in that order, then the multilayer body 22 undergoes calcination, and then outer wiring conductors CL3311 to CL3316 included on the upper surface of the multilayer body 22 and the outer electrodes 241 to 244 included on the lower surface of the multilayer body 22 are plated.

A preparation process of the multilayer body 22 is specifically described as follows. In general, the multilayer body 22 is defined by a multilayer body in a collective board which includes a plurality of laminated coil components 10, and the multilayer body in the collective board is then divided into individual entities so as to obtain each individual multilayer body 22. However, for the sake of convenience of explanation, a preparation process of a single multilayer body 22 is described below.

The nonmagnetic layers L21, L27, and L33 each take a Cu—Zn based ferrite as a main ingredient. The magnetic layers L22 to L26 and L28 to L32 each take a Ni—Cu—Zn or Ni—Mn based ferrite as a main ingredient.

Figure 17A:
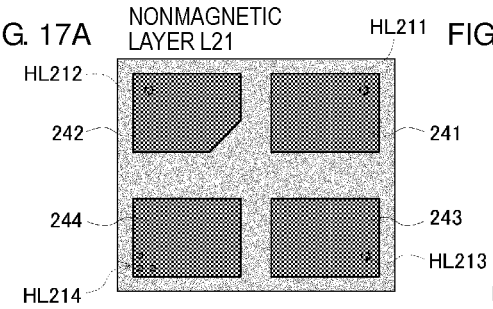
FIG. 17A shows outer electrodes located on a nonmagnetic layer L21 as a basic member of the laminated coil component according to the fourth preferred embodiment of the present invention.
Figure 17E:
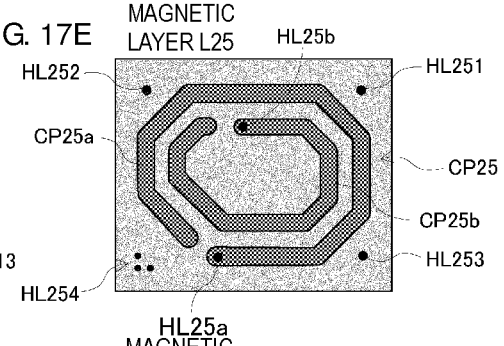
FIG. 17E shows a coil conductor and through-holes included in a magnetic layer L25 as a basic member of the laminated coil component according to the fourth preferred embodiment of the present invention.
Figure 17B:
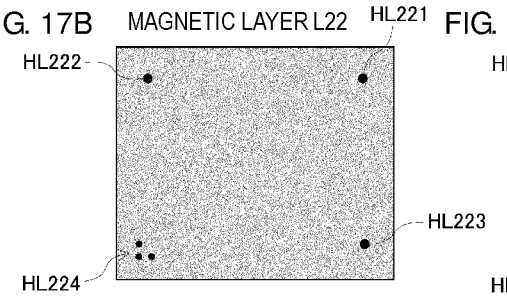
FIG. 17B shows through-holes included in the magnetic layer L22 as a basic member of the laminated coil component according to the fourth preferred embodiment of the present invention.
Figure 17F:
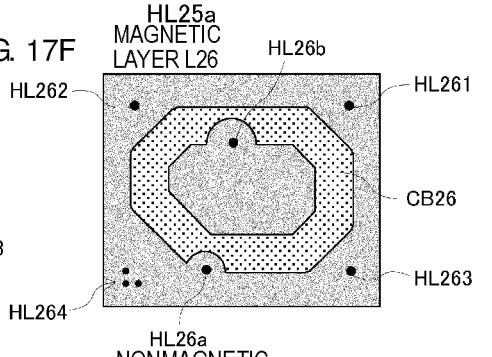
FIG. 17F shows a carbon paste and through-holes included in a magnetic layer L26 as a basic member of the laminated coil component according to the fourth preferred embodiment of the present invention.
Figure 17C:
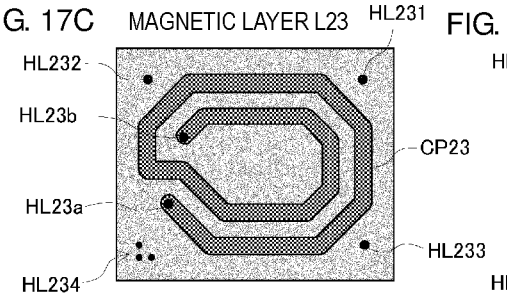
FIG. 17C shows a coil conductor and through-holes included in a magnetic layer L23 as a basic member of the laminated coil component according to the fourth preferred embodiment of the present invention.
Figure 17G:
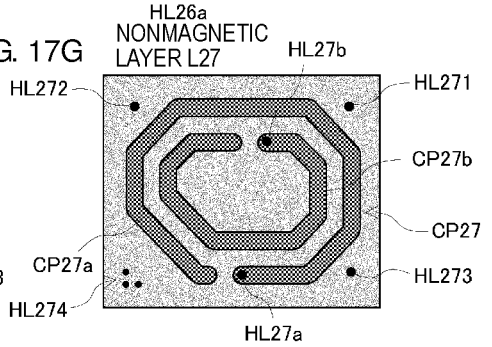
FIG. 17G shows a coil conductor and through-holes included in a nonmagnetic layer L27 as a basic member of the laminated coil component according to the fourth preferred embodiment of the present invention.

FIGS. 17A to 17H and FIGS. 18A to 18F illustrate respective layers viewed from the lower side, that is, from the negative side of the Z axis direction. However, FIG. 18F illustrates an upper surface of the nonmagnetic layer L33 viewed from the lower side in a see-through manner.

Prior to the lamination, the outer electrodes 241 to 244 are applied on a lower surface of the nonmagnetic layer L21. A spiral-shaped coil conductor CP23, circular coil conductors CP24 to CP25, CP27 to CP29, and CP31 defining the coil CIL11 are applied on respective lower surfaces of the magnetic layers L23 to L25, the nonmagnetic layer L27, the magnetic layers L28, L29, and L31. Carbon pastes CB26 and CB30 as an example of the material that defines the air gap are applied on respective lower surfaces of the magnetic layers L26 and L30. Inner wiring conductors CL331 to CL335 are applied on a lower surface of the nonmagnetic layer L33, and the outer wiring conductors CL3311 to CL3316 and an outer wiring conductor CL3317 are applied on an upper surface of the nonmagnetic layer 33.

The nonmagnetic layer L21, the magnetic layers L22 to L26, the nonmagnetic layer L27, the magnetic layers L28 to L32, and the nonmagnetic layer L33 are stacked in that order and pressure-bonded in the Z axis direction to prepare a multilayer body before calcination. The multilayer body 22 is completed by calcining the multilayer body and performing plating.

The coil conductors CP23 to CP25, CP27 to CP29, and CP31, the inner wiring conductors CL331 to CL335, and the outer wiring conductors CL3311 to CL3317 are defined by screen printing of an electrode paste whose main ingredient is Ag, Ag—Pd, Ag—Pt, Cu, Au, Pt, Al, or the like. The carbon pastes CB26 and CB30 are defined by screen printing of a slurry whose main ingredient is carbon.

When the multilayer body 22 is viewed in the Z axis direction, the coil conductors CP23 to CP25, CP27 to CP29, and CP31 at least partially overlap with each other and define two circles. Even with respect to only the coil conductors CP25 and CP27 adjacent to or in the vicinity of each other in the Z axis direction, the coil conductors CP25 and CP27 define two circles when viewed in the Z axis direction. Even with respect to only the coil conductors CP29 and CP31 adjacent to or in the vicinity of each other in the Z axis direction, the coil conductors CP29 and CP31 define two circles when viewed in the Z axis direction.

Figure 17D:
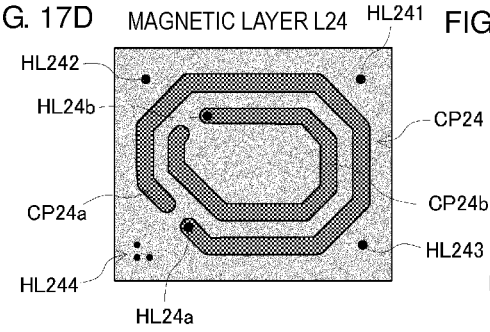
FIG. 17D shows a coil conductor and through-holes included in a magnetic layer L24 as a basic member of the laminated coil component according to the fourth preferred embodiment of the present invention.

As shown in FIG. 17D, the coil conductor CP24 includes a partial coil conductor CP24*a* corresponding to the outer side portion circle defining the two circles, and a partial coil conductor CP24*b* corresponding to the inner side portion circle defining the two circles and including the same or substantially the same width as the partial coil conductor CP24*a*.

As shown in FIG. 17E, the coil conductor CP25 includes a partial coil conductor CP25*a* corresponding to the outer side portion circle defining the two circles, and a partial coil conductor CP25*b* corresponding to the inner side portion circle defining the two circles and including the same or substantially the same width as the partial coil conductor CP25*a*.

As shown in FIG. 17G, the coil conductor CP27 includes a partial coil conductor CP27*a* corresponding to the outer side portion circle defining the two circles, and a partial coil conductor CP27*b* corresponding to the inner side portion circle defining the two circles and including the same or substantially the same width as the partial coil conductor CP27*a*.

Figure 17H:
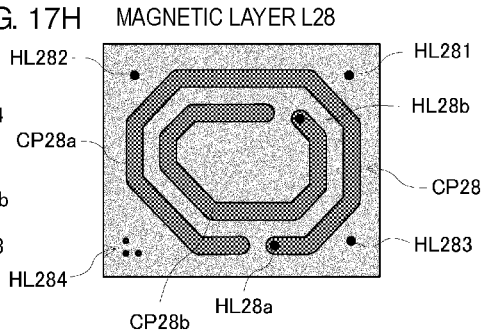
FIG. 17H shows a coil conductor and through-holes included in a magnetic layer L28 as a basic member of the laminated coil component according to the fourth preferred embodiment of the present invention.

As shown in FIG. 17H, the coil conductor CP28 includes a partial coil conductor CP28*a* corresponding to the outer side portion circle defining the two circles, and a partial coil conductor CP28*b* corresponding to the inner side portion circle defining the two circles and including the same or substantially the same width as the partial coil conductor CP28*a*.

Figure 18A:
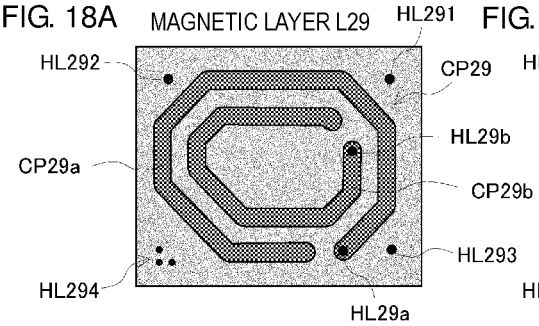
FIG. 18A shows a coil conductor and through-holes included in a magnetic layer L29 as a basic member of the laminated coil component according to the fourth preferred embodiment of the present invention.
Figure 18D:
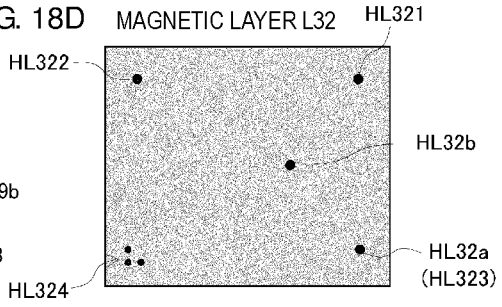
FIG. 18D shows through-holes included in a magnetic layer L32 as a basic member of the laminated coil component according to the fourth preferred embodiment of the present invention.
Figure 18B:
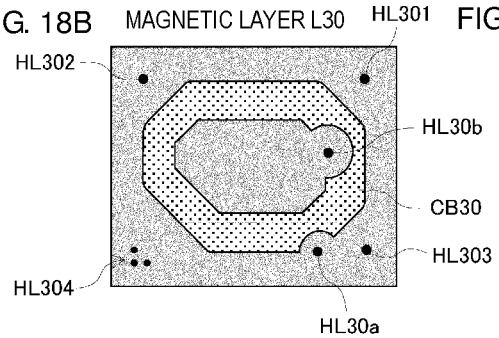
FIG. 18B shows a carbon paste and through-holes included in a magnetic layer L30 as a basic member of the laminated coil component according to the fourth preferred embodiment of the present invention.
Figure 18E:
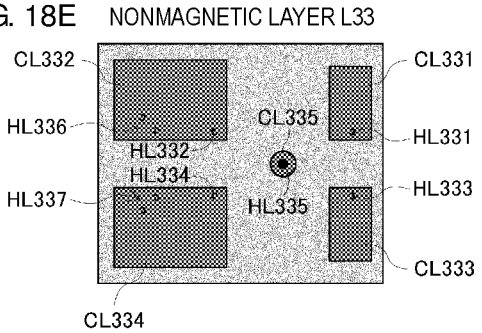
FIG. 18E shows inner wiring conductors and through-holes included in a nonmagnetic layer L33 as a basic member of the laminated coil component according to the fourth preferred embodiment of the present invention.

As shown in FIG. 18A, the coil conductor CP29 includes a partial coil conductor CP29*a* corresponding to the outer side portion circle defining the two circles, and a partial coil conductor CP29*b* corresponding to the inner side portion circle defining the two circles and including the same or substantially the same width as the partial coil conductor CP29*a*.

Figure 18C:
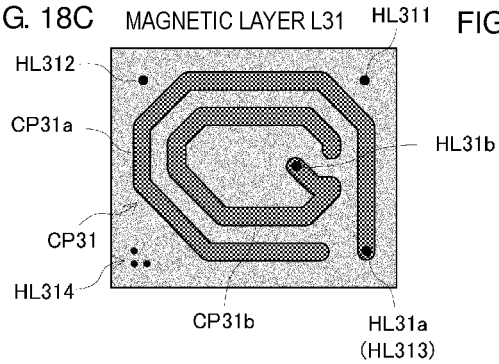
FIG. 18C shows a coil conductor and through-holes included in a magnetic layer L31 as a basic member of the laminated coil component according to the fourth preferred embodiment of the present invention.
Figure 18F:
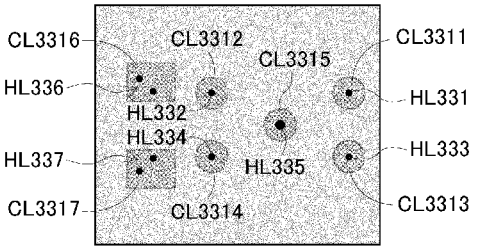
FIG. 18F shows outer wiring conductors included on the nonmagnetic layer L33 are viewed in a see-through manner.

As shown in FIG. 18C, the coil conductor CP31 includes a partial coil conductor CP31*a* corresponding to the outer side portion circle defining the two circles, and a partial coil conductor CP31*b* corresponding to the inner side portion circle defining the two circles and including the same or substantially the same width as the partial coil conductor CP31*a*.

As shown in FIG. 17C, the coil conductor CP23 defines a double-spiral shape when viewed in the Z axis direction. When viewed in the Z axis direction, a portion of the spiral shape at least partially overlaps with the outer side portion circle defining the two circles while another portion of the spiral shape at least partially overlaps with the inner side portion circle defining the two circles.

The outer electrode 241 is connected to the inner wiring conductor CL331 included on the lower surface of the nonmagnetic layer L33 through via hole conductors HL211, HL221, HL231, HL241, HL251, HL261, HL271, HL281, HL291, HL301, HL311, and HL321 included in the nonmagnetic layer L21, the magnetic layers L22 to L26, the nonmagnetic layer L27, and the magnetic layers L28 to L32, respectively.

The outer electrode 242 is connected to the inner wiring conductor CL332 included on the lower surface of the nonmagnetic layer L33 through via hole conductors HL212, HL222, HL232, HL242, HL252, HL262, HL272, HL282, HL292, HL302, HL312, and HL322 included in the nonmagnetic layer L21, the magnetic layers L22 to L26, the nonmagnetic layer L27, and the magnetic layers L28 to L32, respectively.

The outer electrode 243 is connected to the inner wiring conductor CL333 included on the lower surface of the nonmagnetic layer L33 through via hole conductors HL213, HL223, HL233, HL243, HL253, HL263, HL273, HL283, HL293, HL303, HL313, and HL323 included in the nonmagnetic layer L21, the magnetic layers L22 to L26, the nonmagnetic layer L27, and the magnetic layers L28 to L32, respectively.

The outer electrode 244 is connected to the inner wiring conductor CL334 included on the lower surface of the nonmagnetic layer L33 through via hole conductors HL214, HL224, HL234, HL244, HL254, HL264, HL274, HL284, HL294, HL304, HL314, and HL324 included in the nonmagnetic layer L21, the magnetic layers L22 to L26, the nonmagnetic layer L27, and the magnetic layers L28 to L32, respectively.

One end of the coil conductor CP23 is connected to one end of the partial coil conductor CP24*a* through a via hole conductor HL23*a* included in the magnetic layer L23. Further, the other end of the coil conductor CP23 is connected to one end of the partial coil conductor CP24*b* through a via hole conductor HL23*b* included in the magnetic layer L23.

The other end of the partial coil conductor CP24*a* is connected to one end of the partial coil conductor CP25*a* through a via hole conductor HL24*a* included in the magnetic layer L24. Further, the other end of the partial coil conductor CP24*b* is connected to one end of the partial coil conductor CP25*b* through a via hole conductor HL24*b* included in the magnetic layer L24.

The other end of the partial coil conductor CP25*a* is connected to one end of the partial coil conductor CP27*a* through a via hole conductor HL25*a* included in the magnetic layer L25 and a via hole conductor HL26*a* included in the nonmagnetic layer L26. Further, the other end of the partial coil conductor CP25*b* is connected to one end of the partial coil conductor CP27*b* through a via hole conductor HL25*b* included in the magnetic layer L25 and a via hole conductor HL26*b* included in the nonmagnetic layer L26.

The other end of the partial coil conductor CP27*a* is connected to one end of the partial coil conductor CP28*a* through a via hole conductor HL27*a* included in the magnetic layer L27. Further, the other end of the partial coil conductor CP27*b* is connected to one end of the partial coil conductor CP28*b* through a via hole conductor HL27*b* included in the magnetic layer L27.

The other end of the partial coil conductor CP28*a* is connected to one end of the partial coil conductor CP29*a* through a via hole conductor HL28*a* included in the magnetic layer L28. Further, the other end of the partial coil conductor CP28*b* is connected to one end of the partial coil conductor CP29*b* through a via hole conductor HL28*b* included in the magnetic layer L28.

The other end of the partial coil conductor CP29*a* is connected to one end of the partial coil conductor CP31*a* through a via hole conductor HL29*a* included in the magnetic layer L29 and a via hole conductor HL30*a* included in the nonmagnetic layer L30. Further, the other end of the partial coil conductor CP29*b* is connected to one end of the partial coil conductor CP31*b* through a via hole conductor HL29*b* included in the magnetic layer L29 and a via hole conductor HL30*b* included in the nonmagnetic layer L30.

The other end of the partial coil conductor CP31*a* is connected to the inner wiring conductor CL333 through a via hole conductor HL31*a* included in the magnetic layer L31 and a via hole conductor HL32*a* included in the magnetic layer L32. Further, the other end of the partial coil conductor CP31*b* is connected to the inner wiring conductor CL333 through a via hole conductor HL31*b* included in the magnetic layer L31 and a via hole conductor HL32*b* included in the magnetic layer L32. The via hole conductor HL31*a* and the via hole conductor HL313 are the same conductor, and the via hole conductor HL32*a* and the via hole conductor HL323 are also the same conductor.

Via hole conductors HL331 to HL337 are included in the nonmagnetic layer L33. The inner wiring conductor CL331 is connected to the outer wiring conductor CL3311 through the via hole conductor HL331. The inner wiring conductor CL333 is connected to the outer wiring conductor CL3313 through the via hole conductor HL333. The inner wiring conductor CL335 is connected to the outer wiring conductor CL3315 through the via hole conductor HL335.

The inner wiring conductor CL332 is connected to the outer wiring conductor CL3312 through the via hole conductor HL332, and the inner wiring conductor CL332 is connected to the outer wiring conductor CL3316 through the via hole conductor HL336. The inner wiring conductor CL334 is connected to the outer wiring conductor CL3314 through the via hole conductor HL334, and inner wiring conductor CL334 is connected to the outer wiring conductor CL3317 through the via hole conductor HL337.

As a result, one end of the coil CIL11 is connected to the outer wiring conductor CL3313 and the other end of the coil CIL11 is connected to the outer wiring conductor CL3315.

The via hole conductors HL1*a* to HL11*a* and HL1*b* to HL11*b* are defined by filling a conductive paste whose main ingredient is Ag, Ag—Pd, Ag—Pt, Cu, Au, Pt, Al, or the like and calcining the paste in a calcination process.

In the fourth preferred embodiment, the carbon paste CB26 included on the magnetic layer L26 defines a single circle along the two circles defined by the coil conductors CP25 and CP27 when viewed in the Z axis direction. A width of this single circle at least partially overlaps an interval between the outer side portion circle and inner side portion circle defining the two circles excluding an area adjacent to or in the vicinity of the via hole conductor HL26*a* and an area adjacent to or in the vicinity of the via hole conductor HL26*b*. To be more specific, an outer circumference edge of the single circle extends circularly on the outer side portion circle excluding an area adjacent to or in the vicinity of the via hole conductor HL26*a*. An inner circumference edge of the single circle extends circularly on the inner side portion circle excluding an area adjacent to or in the vicinity of the via hole conductor HL26*b*.

The carbon paste CB30 included on the magnetic layer L30 defines a single circle along the two circles defined by the coil conductors CP29 and CP31 when viewed in the Z axis direction. A width of this single circle at least partially overlaps an interval between the outer side portion circle and inner side portion circle defining the two circles excluding an area adjacent to or in the vicinity of the via hole conductor HL30*a* and an area adjacent to or in the vicinity of the via hole conductor HL30*b*. More specifically, an outer circumference edge of the single circle extends circularly on the outer side portion circle excluding an area adjacent to or in the vicinity of the via hole conductor HL30*a*. An inner circumference edge of the single circle extends circularly on the inner side portion circle excluding an area adjacent to or in the vicinity of the via hole conductor HL30*b*.

Also in the fourth preferred embodiment, the carbon paste CB26 or CB30 is shifted to an interval between the outer side portion circle and inner side portion circle defining the two circles at the time of stacking and pressure-bonding. A lack of pressure generated in the interval is at least partially compensated by the shifting of the carbon paste CB26 or CB30. Accordingly, unintended separation of the nonmagnetic layer L21, the magnetic layers L22 to L26, the nonmagnetic layer L27, the magnetic layers L28 to L32, and the nonmagnetic layer L33 is significantly reduced or prevented.

Further, defining the air gaps AG11 and AG12 makes it difficult for a magnetic field to be generated in an interval region between the outer side portion circle and the inner side portion circle, and the inductance value of the coil CIL11 is able to be stabilized at or in the vicinity of the design value.

Figure 19:
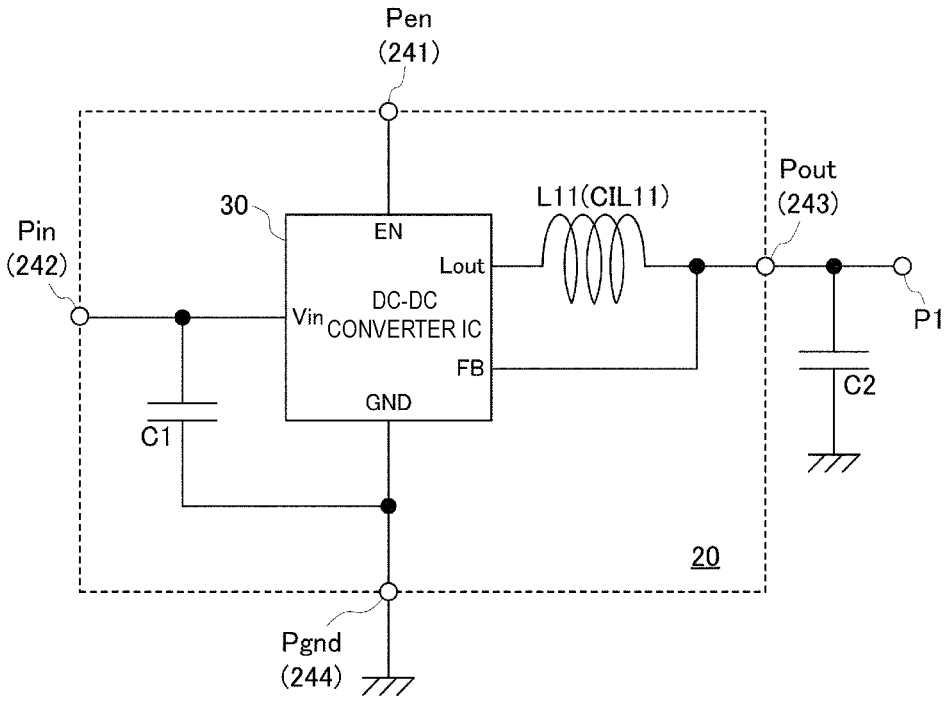
FIG. 19 is a circuit diagram showing an equivalent circuit of the laminated coil component according to the fourth preferred embodiment of the present invention.

FIG. 19 illustrates an equivalent circuit of the LGA laminated coil component 20. FIG. 19 also illustrates a connection relationship among a capacitor C2, an output terminal P1, and the ground that are provided outside of the laminated coil component 20. Both the capacitors C1 and C2 are smoothing capacitors. The capacitor C2 may be provided inside the laminated coil component 20.

According to FIG. 19, the DC-DC converter IC 30 includes an enable terminal EN, an input terminal Vin, an output terminal Lout, a feedback terminal FB, and a ground terminal GND. The enable terminal EN is directly connected to an outer terminal Pen corresponding to the outer electrode 241, the input terminal Pin is directly connected to an outer terminal Vin corresponding to the outer electrode 242. The output terminal Lout is connected to an outer terminal Pout corresponding to the outer electrode 243 with an inductor L11 corresponding to the coil CIL11 interposed between the output terminal Lout and the outer terminal Pout, and the feedback terminal FB is directly connected to the outer terminal Pout.

Further, the ground terminal GND is connected to the outer terminal Pin through the capacitor C1, and the ground terminal GND is directly connected to an outer terminal Pgnd corresponding to the outer electrode 244. The outer terminal Pout is directly connected to the output terminal P1, and the outer terminal Pout is connected to the ground through the capacitor C2. The outer terminal Pgnd is directly connected to the ground.

An input voltage is applied to the outer terminal Pin and supplied to the DC-DC converter IC 30 through the input terminal Vin. The DC-DC converter IC 30 converts the input voltage supplied through the input terminal Vin to a pulse voltage by switching on/off a built-in switching element such as an MOS FET or the like at a predetermined frequency, for example. The converted pulse voltage is smoothed by the inductor L11 and the capacitor C2 then output through the output terminal P1. The ON/OFF period of the switching element is adjusted by PWM (pulse width modulation) control based on a voltage applied to the feedback terminal FB. With this, the output voltage is stabilized.

In the first through fourth preferred embodiments, the inner electrodes such as coil conductors, wiring conductors, and so on are defined by calcining electrode pastes at the same time as a raw multilayer body being calcined, a process referred to as co-firing. On the other hand, the outer electrodes may be defined by co-firing, similar to the inner electrodes, or may be defined by performing application and baking on a ferrite board after sintering, a process referred to as post-firing. Further, the calcination atmosphere is not limited to any specific atmosphere such as oxidation, reduction, or the like in both co-firing and post-firing.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A laminated coil component comprising:

a plurality of magnetic layers stacked and pressure-bonded in a first direction; and a plurality of coil conductors defining a coil which is wound in multiple turns in each of the first direction and a second direction perpendicular or substantially perpendicular to the first direction and has a winding axis extending in the first direction are respectively included; wherein the plurality of coil conductors include two specific coil conductors that are adjacent to or in a vicinity of each other in the first direction and that define multiple circles or substantially circular shapes when viewed in the first direction;

the two specific coil conductors each include a plurality of partial coil conductors respectively corresponding to a plurality of circles or substantially circular shapes defining the multiple circles or substantially circular shapes; and an air gap is defined at a position between the two specific coil conductors when viewed in the second direction, the air gap including a width that at least partially overlaps an interval between the plurality of circles or substantially circular shapes defining the multiple circles or substantially circular shapes when viewed in the first direction and extending along the multiple circles or substantially circular shapes.

2. The laminated coil component according to claim 1, wherein the air gap defines a circle or a substantially circular shape when viewed in the first direction.

3. The laminated coil component according to claim 1, wherein the air gap is defined by a material that vanishes when calcined.

4. The laminated coil component according to claim 3, wherein the material is a carbon paste.

5. The laminated coil component according to claim 3, wherein the material defines a circle or a substantially circular shape when viewed in the first direction.

6. The laminated coil component according to claim 1, wherein the plurality of partial coil conductors include a same or substantially a same width when viewed in the first direction.

7. The laminated coil component according to claim 1, wherein the plurality of coil conductors at least partially overlaps with each other when viewed in the first direction.

8. The laminated coil component according to claim 1, wherein an integrated circuit is mounted on a top surface of a multilayer body.

9. The laminated coil component according to claim 8, wherein:

a first end of the coil is connected to a first outer electrode located on a surface of the multilayer body by a first via hole conductor; and a second end of the coil is connected to a second outer electrode located on a surface of the multilayer body by a second via hole conductor and a wiring conductor.

10. The laminated coil component according to claim 8, wherein the multilayer body is plated.

11. The laminated coil component according to claim 1, wherein the coil is wound in two turns in a plane direction of the plurality of magnetic layers and in seven turns in a lamination direction.

12. The laminated coil component according to claim 1, wherein at least one of the plurality of coil conductors defines a double-spiral shape when viewed in the first direction.

13. A manufacturing method for a laminated coil component that is defined by stacking and pressure-bonding a plurality of magnetic layers in a first direction where a plurality of coil conductors defining a coil which is wound in multiple turns in each of the first direction and a second direction perpendicular or substantially perpendicular to the first direction and including a winding axis extending in the first direction are respectively included, and then calcining the pressure-bonded magnetic layers;

the plurality of coil conductors including two specific coil conductors that are adjacent to or in a vicinity of each other in the first direction and that define multiple circles or substantially circular shapes when viewed in the first direction, the two specific coil conductors each including a plurality of partial coil conductors respectively corresponding to a plurality of circles or substantially circular shapes defining the multiple circles or substantially circular shapes, and an air gap being defined at a position sandwiched between the two specific coil conductors when viewed in the second direction, the air gap including a width that at least partially overlaps an interval between the plurality of circles or substantially circular shapes defining the multiple circles or substantially circular shapes when viewed in the first direction and extending along the multiple circles or substantially circular shapes, the method comprising:

a first application process in which the two specific coil conductors are applied on two respective magnetic layers;

a second application process in which a material to define the air gap is applied on a magnetic layer different from the two magnetic layers on which the first application process is performed; and a preparation process in which a multilayer body before calcination is prepared by inserting the magnetic layer processed by the second application process between the two magnetic layers processed by the first application process.

14. A manufacturing method for a laminated coil component that is defined by stacking and pressure-bonding a plurality of magnetic layers in a first direction where a plurality of coil conductors defining a coil which is wound in multiple turns in each of the first direction and a second direction perpendicular or substantially perpendicular to the first direction and including a winding axis extending in the first direction are respectively included, and then calcining the pressure-bonded magnetic layers, the plurality of coil conductors including two specific coil conductors that are adjacent to or in a vicinity of each other in the first direction and that define multiple circles or substantially circular shapes when viewed in the first direction, the two specific coil conductors each including a plurality of partial coil conductors respectively corresponding to a plurality of circles or substantially circular shapes defining the multiple circles or substantially circular shapes, and an air gap being defined at a position sandwiched between the two specific coil conductors when viewed in the second direction, the air gap including a width that at least partially overlaps an interval between the plurality of circles or substantially circular shapes defining the multiple circles or substantially circular shapes when viewed in the first direction and extending along the multiple circles or substantially circular shapes, the method comprising:

a first application process in which one of the two specific coil conductors is applied on a magnetic layer;

a second application process in which a material to define the air gap is applied on a magnetic layer different from the magnetic layer processed by the first application process;

a third application process in which the other of the two specific coil conductors is applied on the magnetic layer processed by the second application process; and a preparation process in which a multilayer body before calcination is prepared by laminating the magnetic layer processed by the third application process on the magnetic layer processed by the first application process.

15. A laminated coil component comprising:

a multilayer body including a plurality of magnetic layers laminated and a first main surface and a second main surface;

a first outer electrode and a second outer electrode included on the first main surface of the multilayer body; and a coil which is embedded in the multilayer body, a first end of the coil being connected to the first outer electrode and a second end of the coil being connected to the second outer electrode; wherein the coil includes a plurality of circular coil conductors respectively included in the plurality of magnetic layers;

the plurality of circular coil conductors each include an inner side portion coil conductor and an outer side portion coil conductor; and the first outer electrode is connected to the inner side portion coil conductor at the first main surface side, the second outer electrode is connected to the outer side portion coil conductor at the first main surface side, and the inner side portion coil conductor and outer side portion coil conductor are connected at the second main surface side.

16. The laminated coil component according to claim 15, wherein a direction of a current flowing through the outer side portion coil conductor is a same or substantially a same as a direction of a current flowing through the inner side portion coil conductor.

17. The laminated coil component according to claim 15, wherein an air gap is defined between two circular or substantially circular coil conductors adjacent to or in a vicinity of each other in a lamination direction, the air gap including a width that at least partially overlaps an interval between the inner side portion coil conductor and the outer side portion coil conductor when viewed in the lamination direction and extending along the circular or substantially circular coil conductors.

18. The laminated coil component according to claim 17, wherein the air gap is defined by a material that vanishes when calcined.

19. The laminated coil component according to claim 18, wherein the material is a carbon paste.

20. The laminated coil component according to claim 17, wherein the air gap defines a circle or a substantially circular shape when viewed in the first direction.

* * * * *